US006577823B2

(12) United States Patent
Matsuguma et al.

(10) Patent No.: US 6,577,823 B2
(45) Date of Patent: Jun. 10, 2003

(54) METHOD OF DETECTING LIFE OF IMAGE BEARING MEMBER, IMAGE FORMING APPARATUS AND CARTRIDGE

(75) Inventors: Minoru Matsuguma, Shizuoka (JP); Yasuyuki Ishii, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/178,229

(22) Filed: Jun. 25, 2002

(65) Prior Publication Data

US 2003/0026621 A1 Feb. 6, 2003

Related U.S. Application Data

(63) Continuation of application No. 09/879,184, filed on Jun. 13, 2001, now abandoned.

(30) Foreign Application Priority Data

Jun. 15, 2000 (JP) ..... 2000-180629

(51) Int. Cl.[7] ..... G03G 15/00
(52) U.S. Cl. ..... 399/26; 399/25; 399/24
(58) Field of Search ..... 399/24, 25, 26, 399/159

(56) References Cited

U.S. PATENT DOCUMENTS 5,278,612 A 1/1994 Inui ..... 399/26
5,420,671 A 5/1995 Kisu et al.
5,426,488 A 6/1995 Hayakawa et al.
5,835,818 A 11/1998 Hoshika et al. ..... 399/26
5,907,739 A 5/1999 Tsunemi et al. ..... 399/26

FOREIGN PATENT DOCUMENTS

| | | |
|---|---|---|
| JP | 63-149669 | 6/1988 |
| JP | 1-267667 | 10/1989 |
| JP | 4-51259 | 2/1992 |
| JP | 4-98265 | 3/1992 |
| JP | 5-188674 | 7/1993 |
| JP | 5-333626 | 12/1993 |
| JP | 6-130732 | 5/1994 |
| JP | 6-180518 | 6/1994 |

*Primary Examiner*—Hoang Ngo
(74) *Attorney, Agent, or Firm*—Fitzpatrick, Cella, Harper & Scinto

(57) ABSTRACT

A method of detecting the end of the life of an image bearing member has: a contact time detecting step of detecting the contact time when a developer carrying member that can be in contact with or have a clearance with an image bearing member contacts the image bearing member, the developer carrying member developing an electrostatic image formed in the image bearing member by a developer; and a determining step of determining the end of the life of the image bearing member in accordance with a parameter calculated by using the contact time detected in the contact time detecting step.

48 Claims, 9 Drawing Sheets

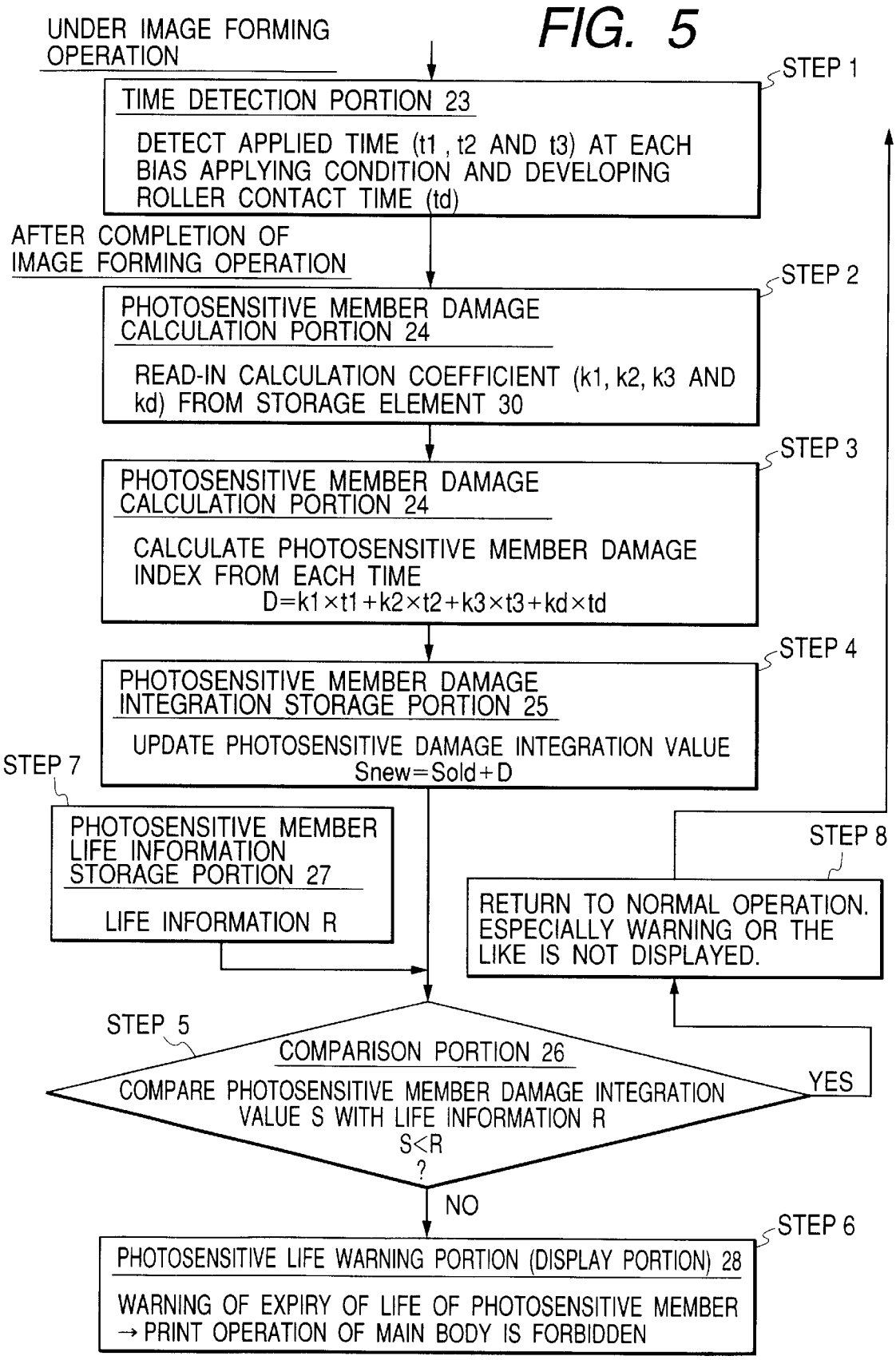
FIG. 5
UNDER IMAGE FORMING OPERATION
STEP 1
TIME DETECTION PORTION 23
DETECT APPLIED TIME (t1, t2 AND t3) AT EACH BIAS APPLYING CONDITION AND DEVELOPING ROLLER CONTACT TIME (td)
AFTER COMPLETION OF IMAGE FORMING OPERATION
STEP 2
PHOTOSENSITIVE MEMBER DAMAGE CALCULATION PORTION 24
READ-IN CALCULATION COEFFICIENT (k1, k2, k3 AND kd) FROM STORAGE ELEMENT 30
STEP 3
PHOTOSENSITIVE MEMBER DAMAGE CALCULATION PORTION 24
CALCULATE PHOTOSENSITIVE MEMBER DAMAGE INDEX FROM EACH TIME
D=k1×t1+k2×t2+k3×t3+kd×td
STEP 4
PHOTOSENSITIVE MEMBER DAMAGE INTEGRATION STORAGE PORTION 25
UPDATE PHOTOSENSITIVE DAMAGE INTEGRATION VALUE
Snew=Sold+D
STEP 7
PHOTOSENSITIVE MEMBER LIFE INFORMATION STORAGE PORTION 27
LIFE INFORMATION R
STEP 8
RETURN TO NORMAL OPERATION. ESPECIALLY WARNING OR THE LIKE IS NOT DISPLAYED.
STEP 5
COMPARISON PORTION 26
COMPARE PHOTOSENSITIVE MEMBER DAMAGE INTEGRATION VALUE S WITH LIFE INFORMATION R
S<R
?
YES
NO
STEP 6
PHOTOSENSITIVE LIFE WARNING PORTION (DISPLAY PORTION) 28
WARNING OF EXPIRY OF LIFE OF PHOTOSENSITIVE MEMBER
→ PRINT OPERATION OF MAIN BODY IS FORBIDDEN

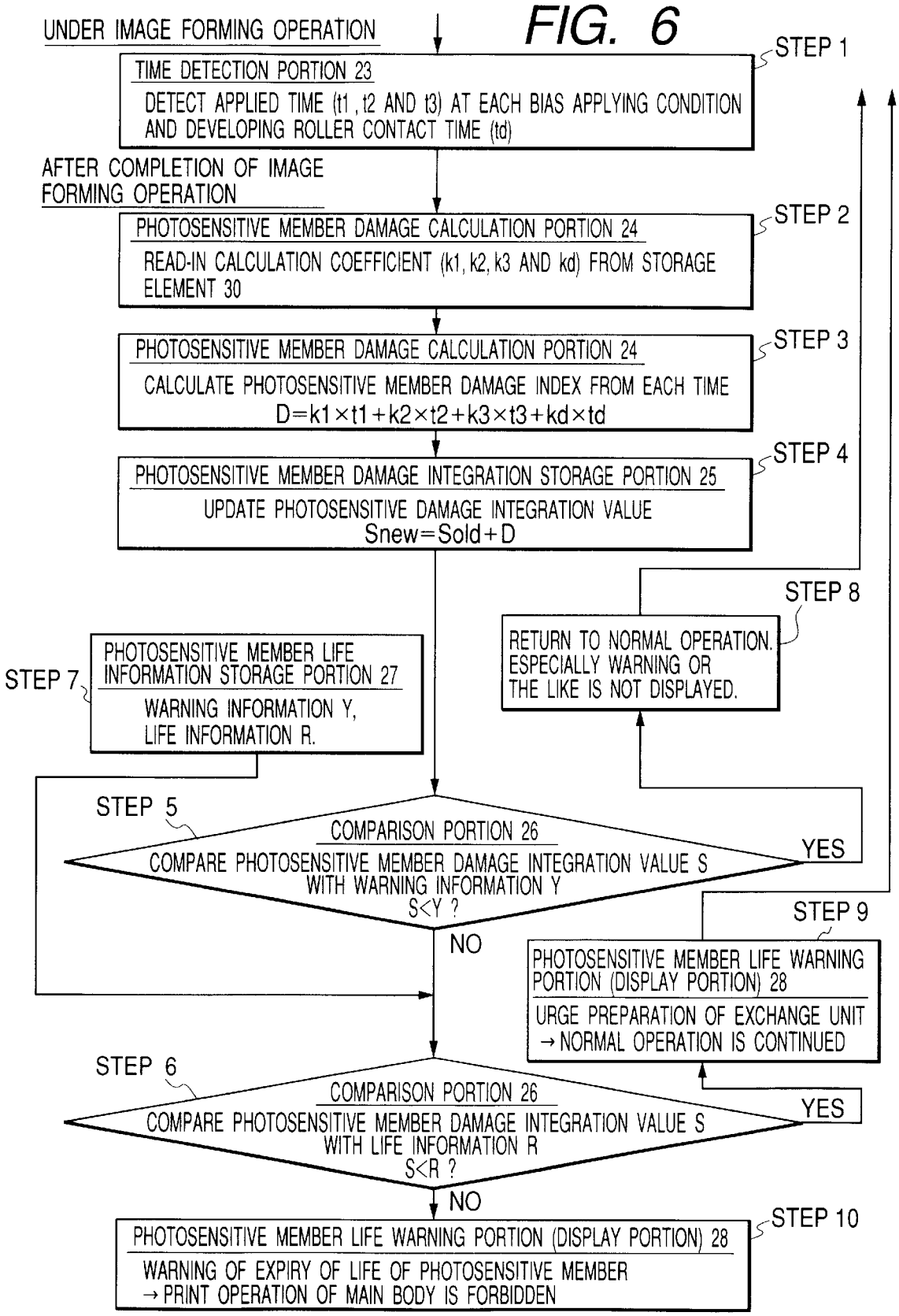
FIG. 6
UNDER IMAGE FORMING OPERATION
STEP 1
TIME DETECTION PORTION 23
DETECT APPLIED TIME (t1, t2 AND t3) AT EACH BIAS APPLYING CONDITION AND DEVELOPING ROLLER CONTACT TIME (td)
AFTER COMPLETION OF IMAGE FORMING OPERATION
STEP 2
PHOTOSENSITIVE MEMBER DAMAGE CALCULATION PORTION 24
READ-IN CALCULATION COEFFICIENT (k1, k2, k3 AND kd) FROM STORAGE ELEMENT 30
STEP 3
PHOTOSENSITIVE MEMBER DAMAGE CALCULATION PORTION 24
CALCULATE PHOTOSENSITIVE MEMBER DAMAGE INDEX FROM EACH TIME
D=k1×t1+k2×t2+k3×t3+kd×td
STEP 4
PHOTOSENSITIVE MEMBER DAMAGE INTEGRATION STORAGE PORTION 25
UPDATE PHOTOSENSITIVE DAMAGE INTEGRATION VALUE
Snew=Sold+D
STEP 8
RETURN TO NORMAL OPERATION. ESPECIALLY WARNING OR THE LIKE IS NOT DISPLAYED.
STEP 7
PHOTOSENSITIVE MEMBER LIFE INFORMATION STORAGE PORTION 27
WARNING INFORMATION Y, LIFE INFORMATION R.
STEP 5
COMPARISON PORTION 26
COMPARE PHOTOSENSITIVE MEMBER DAMAGE INTEGRATION VALUE S WITH WARNING INFORMATION Y
S<Y ?
YES
NO
STEP 9
PHOTOSENSITIVE MEMBER LIFE WARNING PORTION (DISPLAY PORTION) 28
URGE PREPARATION OF EXCHANGE UNIT
→NORMAL OPERATION IS CONTINUED
STEP 6
COMPARISON PORTION 26
COMPARE PHOTOSENSITIVE MEMBER DAMAGE INTEGRATION VALUE S WITH LIFE INFORMATION R
S<R ?
YES
NO
STEP 10
PHOTOSENSITIVE MEMBER LIFE WARNING PORTION (DISPLAY PORTION) 28
WARNING OF EXPIRY OF LIFE OF PHOTOSENSITIVE MEMBER
→PRINT OPERATION OF MAIN BODY IS FORBIDDEN

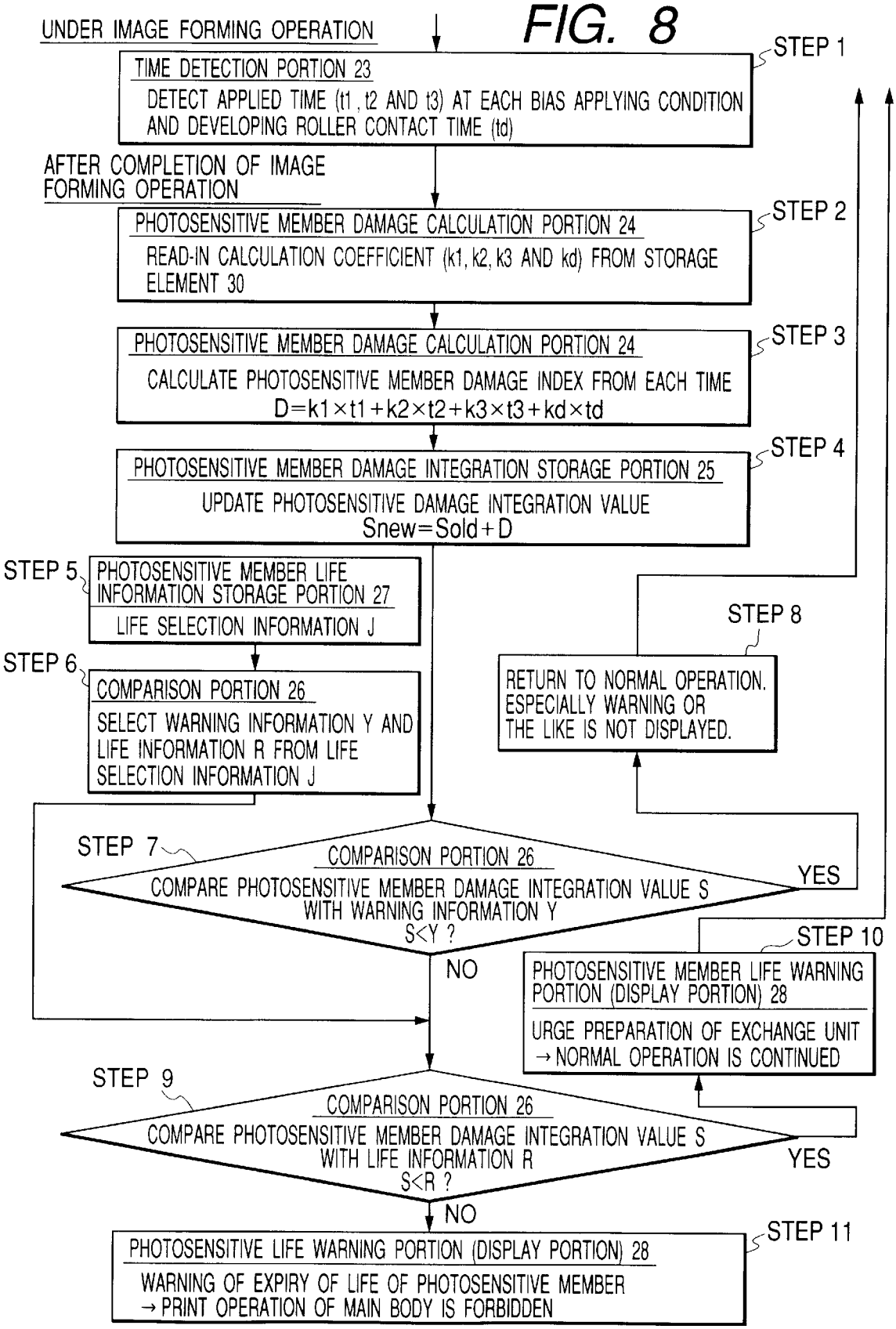
FIG. 8
UNDER IMAGE FORMING OPERATION
STEP 1
TIME DETECTION PORTION 23
DETECT APPLIED TIME (t1, t2 AND t3) AT EACH BIAS APPLYING CONDITION AND DEVELOPING ROLLER CONTACT TIME (td)
AFTER COMPLETION OF IMAGE FORMING OPERATION
STEP 2
PHOTOSENSITIVE MEMBER DAMAGE CALCULATION PORTION 24
READ-IN CALCULATION COEFFICIENT (k1, k2, k3 AND kd) FROM STORAGE ELEMENT 30
STEP 3
PHOTOSENSITIVE MEMBER DAMAGE CALCULATION PORTION 24
CALCULATE PHOTOSENSITIVE MEMBER DAMAGE INDEX FROM EACH TIME
D=k1×t1+k2×t2+k3×t3+kd×td
STEP 4
PHOTOSENSITIVE MEMBER DAMAGE INTEGRATION STORAGE PORTION 25
UPDATE PHOTOSENSITIVE DAMAGE INTEGRATION VALUE
Snew=Sold+D
STEP 5
PHOTOSENSITIVE MEMBER LIFE INFORMATION STORAGE PORTION 27
LIFE SELECTION INFORMATION J
STEP 6
COMPARISON PORTION 26
SELECT WARNING INFORMATION Y AND LIFE INFORMATION R FROM LIFE SELECTION INFORMATION J
STEP 8
RETURN TO NORMAL OPERATION. ESPECIALLY WARNING OR THE LIKE IS NOT DISPLAYED.
STEP 7
COMPARISON PORTION 26
COMPARE PHOTOSENSITIVE MEMBER DAMAGE INTEGRATION VALUE S WITH WARNING INFORMATION Y
S<Y ?
YES
NO
STEP 10
PHOTOSENSITIVE MEMBER LIFE WARNING PORTION (DISPLAY PORTION) 28
URGE PREPARATION OF EXCHANGE UNIT
→NORMAL OPERATION IS CONTINUED
STEP 9
COMPARISON PORTION 26
COMPARE PHOTOSENSITIVE MEMBER DAMAGE INTEGRATION VALUE S WITH LIFE INFORMATION R
S<R ?
YES
NO
STEP 11
PHOTOSENSITIVE LIFE WARNING PORTION (DISPLAY PORTION) 28
WARNING OF EXPIRY OF LIFE OF PHOTOSENSITIVE MEMBER
→PRINT OPERATION OF MAIN BODY IS FORBIDDEN

METHOD OF DETECTING LIFE OF IMAGE BEARING MEMBER, IMAGE FORMING APPARATUS AND CARTRIDGE

CROSS REFERENCE TO RELATED APPLICATION

This application is a Continuation of application Ser. No. 09/879,184, filed Jun. 13, 2001, now abanonded.

BACKGROUND OF THE INVENTION

1. Field of the Invention

The present invention generally relates to a method of detecting life of an image bearing member used in an image forming apparatus for forming an electrostatic latent image in an image bearing member by, for example, an electrophotographic system or an electrostatic recording system and visualizing the electrostatic latent image with a developer, to an image forming apparatus using the above method, and further, to a cartridge detachably attachable to the image forming apparatus.

Here, the image forming apparatus with the electrophotographic system include, for example, an electrophotographic copier, an electrophotographic printer (for example, an LED printer and a laser beam printer), and an electrophotographic facsimile.

The cartridge detachably attachable to the main body of the electrophotograph image forming apparatus indicates the cartridge having at least one of an electrophotographic photosensitive member, charging means for charging the electrophotograh photosensitive member, developing means for supplying a developer to the electrophotographic photosensitive member and cleaning means for cleaning the electrophotographic photosensitive member. In particular, a process cartridge indicates the cartridge in which at least one of the charging means, the developing means and the cleaning means, and the electrophotographic photosensitive member are integrally made into the cartridge, and the cartridge is made detachably attachable to the main body of the electrophotograph image forming apparatus, or the cartridge in which at least the developing means and the electrophotographic photosensitive member are integrally made into the cartridge and the cartridge is detachably attachable to the main body of the electrophotograph image forming apparatus.

2. Related Background Art

Conventionally, in an image forming apparatus of an electrophotographic system such as an electrophotographic copier or a laser beam printer, an electrophotographic photosensitive member as an image bearing member is uniformly electrified by using charging means, and thereafter, the surface is irradiated with light corresponding to image information to form a latent image. Then, a developer is supplied to the latent image using developing means to visualize the latent image, and after the visualized image is transferred to a recording medium, the image is fixed in a fixing apparatus to obtain an image on the recording medium. Further, the electrophotographic photosensitive member after the transfer is cleaned with cleaning means.

In such an image forming apparatus, in order to attain simpleness and easiness of exchange and maintenance of expendable supplies such as the electrophotographic photosensitive member and the developer, there is a process cartridge system in which an electrophotographic photosensitive member, developing means as process means acting on the electrophotographic photosensitive member, charging means, cleaning means, and further, a container for a developer and a container for a waste developer are integrally made into a process cartridge, and the cartridge is detachably attachable to the main body of the image forming apparatus.

According to the cartridge system, a user can conduct maintenance of the apparatus without a serviceman. Images can be formed again by exchanging a cartridge by the user when the developer has run out or when the photosensitive member drum has expired, for example. As described above, the cartridge system can remarkably improve operability of the apparatus, and thus, is widely used in the electrophotograph image forming apparatuses.

In the image forming apparatus of the cartridge system, for example, it is necessary that the user can exchange the cartridge at an appropriate time by notifying the user that the expendable supplies such as the electrophotographic photosensitive member and the developer have expired or that they are approaching the expiry of life.

Conventionally, as a method of detecting life of an electrophotographic photosensitive member having, for example, a cylindrical shape, that is, a photosensitive member drum:

(1) there is a method of detecting life of a photosensitive member drum by integrating the number of sheets of image formation. In the simplest method, in the case where the size of the sheets of the recording medium, on which an image is formed, differs, for example, between A4 size and A3 size, the sheets of the recording medium are counted as the same. However, in this method, the precision of detecting the life of the photosensitive member drum is not satisfactory. Further, with only integration of the number of sheets of image formation, rotation time of the photosensitive member drum per one sheet of the recording medium differs depending on how many sheets are conducted with image formation per one job, that is, how many sheets of the recording medium are conducted with continuous image formation from the start of the image forming operation. Thus, the life of the photosensitive member drum varies in accordance with the rotation time, which is described later. Therefore, in this method, the precision of detecting the life of the photosensitive member drum is not satisfactory.

Moreover, (2) as described in Japanese Patent Application Laid-open No. 4-51259 as a prior art, there is a method of detecting a charge amount of a photosensitive drum with a surface potential sensor. In accordance with this method, in actuality, a reduction of charge potential of the photosensitive member drum or a reduction of latent image contrast can be directly detected with the surface potential sensor. Thus, in comparison with the method of (1) described above, life detection with satisfactory precision is possible, which reflects the state of an output image. However, in order to implement the above method, the surface potential sensor, an electric circuit for processing the output, and the like are needed, and thus, the cost increases. Further, with respect to a longitudinal direction of the photosensitive member drum, only the information on the photosensitive member drum corresponding to the sensor position is data to make a decision. Thus, the detection ability to a partial defect is weak, and there are variation of the surface potential sensor and instability of change with time and the like. Therefore, this method is not necessarily a method of constantly detecting the life of the photosensitive member drum with accuracy.

Furthermore, (3) as a method of improving detection accuracy of the life of the photosensitive member drum while solving the problem of the above method (1), there is disclosed, in Japanese Patent Application Laid-open No. 5-188674, a method of integrating the rpm of the photosensitive member drum instead of integrating the number of sheets of image formation. Based on the same principle, there is a method of integrating the rotation time of the photosensitive member drum. In any of the methods, since, with respect to one image formation, as the size of the recording medium becomes larger, the rpm (rotation time) increases while as the size of the recording medium becomes smaller, the rpm (rotation time) decreases, in accordance with the size of the recording medium, the detection error of the life of the photosensitive member drum due to the size difference of the recording medium becomes smaller in comparison with the case of integrating the number of sheets of image formation. Further, the rpm (rotation time) of the photosensitive member drum is directly integrated irrespective of the number of sheets of image formation per one job, and thus, the precision of the life detection is relatively satisfactory.

As a method which is developed on the basis of the above method (3), there is disclosed, in Japanese Patent Application Laid-open No. 4-98265, a method in which the rpm of the photosensitive member drum at the time of actual image formation is integrated by integrating the rpm of the photosensitive member drum only at the time when a transfer charger as transferring means operates so that the life detection of the photosensitive member drum with more accuracy is possible. Further, there is disclosed, in Japanese Patent Application Laid-open No. 6-180518, a method in which the rpm of the photosensitive member drum during an electrification process of the photosensitive member drum, and the rpm of the photosensitive member drum while a cleaning member that cleans the photosensitive member drum contacts, are respectively integrated, and the expiry of life of the photosensitive member drum is determined on the basis of comparison of the respective rpms and the setting values (life).

Further, the following method is known as a method of notifying a user of timing for a process cartridge exchange. Namely, in a method disclosed in Japanese Patent Application Laid-open No. 5-333626, timing for the process cartridge structured with a cleaner (cleaning means) and an electrophotographic photosensitive member is firstly notified to the user on the basis of the life of the electrophotographic photosensitive member. That is, the apparatus is stopped at the time when the electrophotographic photosensitive member reaches the life of a guarantee by integrating the number of sheets of image formation and becomes unusable. Besides, as exchange display operation based on the life of the electrophotograph photosensitive body, the apparatus urges a user to prepare a cartridge for exchange by displaying that the exchange time is approaching the life of a guarantee, or in a case where the cartridge is continuously used, the apparatus warns that the time to stop the apparatus is approaching. Further, in accordance with this conventional technique, the apparatus is structured such that the timing for a cartridge exchange can be notified to the user also based on a toner capacity of a recovered toner containing portion of the cleaner. That is, an on-time of a driving motor for toner replenishment is integrated, and the apparatus is stopped in accordance with the integration time which is expected to come the earliest under the worst condition in which various variations are considered. Also in this case, as the exchange display operation based on the capacity in the toner containing portion, the display to prompt the user to exchange a cartridge at the time when the integration time of the on-time of the driving motor for toner replenishment becomes a certain value is made, and the display to notify the user that the time to stop the apparatus is approaching is made at a later integration time.

In this conventional technique, the operation based on the life of the electrophotographic photosensitive member and the operation based on the toner capacity in the recovered toner containing portion of the cleaner are generally set so as to have priority over the number of prints, that is, the life of the electrophotographic photosensitive member. However, when toner replenishment is frequently conducted because of unusual high image density, and the recovered toner container is about to be filled earlier compared with the life of a guarantee (the number of sheets of a guarantee) of the electrophotographic photosensitive member, an action based on the toner capacity of the recovered toner container works.

Here, in the technique disclosed in Japanese Patent Application Laid-open No. 5-333626, the process cartridge is provided with storage means, the total electrification time of a primary electrifier provided in the image forming apparatus is collectively written in the storage means through a CPU provided in the image forming apparatus at the time of the exchange of the process cartridge, and also, the subsequent electrification time of the primary electrifier Is written and stored in the storage means. Then, the storage means of the spent process cartridge is collected and analyzed, whereby the rpm of the photosensitive member drum at present, and the total amount of discharge time of corotron and the like of the image forming apparatus in which the spent process cartridge has been used can be known with accuracy, and information collection to the image forming apparatus can be conducted at intervals of the exchange of the process cartridge. The above is disclosed. More specifically, the operation cycle number of the photosensitive member drum, the exchange time of an ozone filter, the abrasion (or wear) data prediction of the photosensitive member drum, and the like of the image forming apparatus at the time of the exchange of the process cartridge can be known.

However, the determination of the expiry of life of the photosensitive member drum in the technique disclosed in this application is based on the number of sheets of image formation in the end. As described above, there is no change in the point in that the precision of the life prediction of the photosensitive member drum based on the number of sheets of image formation is not satisfactory.

On the other hand, in recent years, as a developing apparatus for developing a latent image formed on an electrophotographic photosensitive member, there is a apparatus in which so-called one component developer, which substantially contains toner as its only constituent, is used. In this developing apparatus of a one component developing system, mixture of toner and carrier, agitation, and control of toner density (the ratio of the toner to the total amount of the toner and the carrier) are not necessary, dissimilar to a so-called developing apparatus of a two component developing system. Thus, miniaturization of the apparatus and low cost can be realized, and also, exchange work of the developer becomes unnecessary, which is very effective in a printer or the like desired to be maintenance-free. If non-magnetic toner is used as the toner for the one component developer, it becomes unnecessary that a developer carrying member for carrying a developer to an electrophotographic photosensitive member is provided with a magnet roll. Thus, the miniaturization of the apparatus and the low cost can be further realized.

As the developing apparatus of a one component developing system, there is known a so-called developing apparatus of a contact one component developing system comprising: a developer container (hopper) for containing one component developer (toner); a developer carrying member (developing roller) having a roller shape or the like for carrying toner to a latent image on an electrophotographic photosensitive member, which is provided adjacent to the developer container; a toner supply roller rotating in the same direction as the developing roller while contacting the developing roller; and developer layer thickness regulating means (regulating blade) having a blade shape or the like for regulating the toner amount carried on the developing roller, in which the toner in the hopper is carried to the developing roller by the toner supply roller, a toner thin layer is formed on the developing roller by the regulating blade, and the toner thin layer is made in contact with the electrophotographic photosensitive member, to thereby develop the electrostatic latent image formed on the electrophotographic photosensitive member.

In a case where the non-magnetic toner is used as the toner for the one component developer, the regulating blade, which is an elastic blade or the like, is made in contact with the developing roller, Coulomb force due to charge of toner or triboelectrification is utilized to form the toner thin layer on the developing roller, and thus, supplying and carrying toner are conducted.

Further, in recent years, a contact electrifier is widely being used instead of a corona electrifier which has been conventionally widely used as an electrifier for performing an electrification process with an electrophotographic photosensitive member. The contact electrifier has many merits-that lower applied bias is sufficient for the contact electrifier compared with the corona electrifier, that a very small amount of ozone is generated, that the number of the required components that structure the electrifier are small, and that the electrifier is provided at low cost.

Such a contact electrifier is roughly divided into a brush electrifier and a roller electrifier in accordance with a shape of a charging member to be used. The brush electrifier has problems of a track of the brush, a bend of the brush in a case where the electrifier is made in contact with the electrophotographic photosensitive member for a long period of time, and the like. On the other hand, the roller electrifier has difficult problems in that resistance regulation of the roller is necessary in order to obtain uniform electrification, in that contamination of a drum has to be prevented, which arises from bleed from rubber that constitutes the roller, and in that there is a strict limitation on the shape, surface property and the like of the roller in order to obtain uniform electrification.

As the voltage applied to the contact charging member, only a DC bias (hereafter, referred to as "DC electrification") and an AC bias superposed on a DC bias (hereafter, referred to as "AC electrification") are given. Generally, there is a feature that the AC electrification enables uniform electrification compared with the DC electrification.

As the AC electrification, there are electrification in which a charging member having a roller shape (charging roller) is used as a charging member, and a DC voltage is superposed on an AC voltage which is twice or more as large as the voltage at the start of discharge of an applied bias (Japanese Patent Application Laid-open No. 63-149669 and Japanese Patent Application Laid-open No. 1-267667), electrification in which a conductive brush is used as an electrification member, and a DC voltage is superposed on an AC voltage which is twice or less as large as the voltage at the start of discharge of an applied bias (Japanese Patent Application Laid-open No. 6-130732), and the like.

The contact electrification system described above has merits that a small amount of ozone is generated, that the number of the required components that structure the electrifier are small, and that the electrifier is provided at low cost. However, the damage given to the electrophotographic photosensitive member is larger compared with corona electrification. In particular, the tendency is conspicuous in case of using an OPC photosensitive member drum.

Further, even in the same contact electrification method, the damage given to the electrophotographic photosensitive member varies according to the applied voltage to the charging member, and as the applied voltage increases, the damage given to the electrophotographic photosensitive member becomes larger. In case that only the DC voltage is applied as an electrification bias, the damage increases in comparison with the case where the photosensitive member drum is rotated without applying the electrification bias. Moreover, it is found out that the damage (particularly, abrasion amount of the OPC photosensitive member drum) further increases, and the damage is about several times as large as the damage in a case where only the DC voltage is applied as the electrification bias when the AC voltage superposed on the DC voltage is applied as the electrification bias.

In particular, if the AC voltage which is twice or more as large as the voltage at the start of discharge is applied, the increase phenomenon of the damage to the electrophotographic photosensitive member becomes conspicuous. However, even if the AC voltage which is twice or less as large as the voltage at the start of discharge is applied, the damage is about several times as large as the damage in a case where only the DC voltage is applied.

Further, also in a case where the frequency of the AC voltage applied as the electrification bias is made larger, there is a tendency that the damage to the electrophotographic photosensitive member (in particular, the OPC photosensitive member drum) increases.

On the other hand, as described above, in recent years, there is a method in which a developing roller as a developer carrying member is made to carry one component developer, and the developing roller is made in contact with a photosensitive member drum to develop an electrostatic latent image on the photosensitive member drum, but the photosensitive member drum is scraped by contact rotation of the developing roller as well.

In general, in a case where a one component non-magnetic developing apparatus is used, in which a developing roller contacts a photosensitive member drum, a peripheral speed of the developing roller is increased with respect to, for example, a peripheral speed of the photosensitive member drum in order to secure the required density. Particularly, in a case where the developing roller has a relative peripheral speed ratio with respect to the photosensitive member drum, there is a tendency that the damage given to the photosensitive member drum increases.

However, in a color image forming apparatus in which an electrostatic latent image on a photosensitive member drum is developed by switching developing apparatuses of a plurality of colors, and in an image forming apparatus in which a spacing mechanism is provided for having a clearance between a developing roller and a photosensitive member drum, and a method of having a clearance between the developing apparatus and the photosensitive member drum at the rotation of the photosensitive member drum during a non-image formation period is adopted in order to prevent fog of contact development, the rotation time of the photosensitive member drum is not proportional to the contact time of the photosensitive member drum and the developing roller.

As apparent from the above description, in the image forming apparatus which is provided with the charging means that electrifies the photosensitive member drum with, for example, contact electrification under a plurality of electrification conditions during image formation and in which both the AC voltage and the DC voltage are used, the damage that the photosensitive member drum receives varies according to the electrification condition. Thus, with the conventional method of detecting life of the photosensitive member drum on the basis of only the rpm of the photosensitive member drum, it is difficult to predict the life of the photosensitive member drum with accuracy.

Further, in a case where the developing apparatus which can be alienated from the photosensitive member drum is used, the rotation time of the photosensitive member drum is not proportional to the contact time of the photosensitive member drum and the developing roller as described above. Thus, in the conventional method of detecting life of the photosensitive member drum on the basis of only the rpm of the photosensitive member drum, it is impossible to predict the life of the photosensitive member drum with accuracy.

Due to the above reasons, there is a fear that inconvenience occurs such that a warning for a cartridge exchange is not issued although the photosensitive member drum has expired to generate an image defect or such that the warning for a cartridge exchange is issued although the photosensitive member drum has not actually expired yet.

SUMMARY OF THE INVENTION

Accordingly, a main object of the present invention is to provide a method of detecting life of an image bearing member in which that the image bearing member has reached the expiry of life or is approaching the expiry of life can be detected with accuracy, an image forming apparatus, and further, a cartridge detachably attachable to the image forming apparatus.

Another object of the present invention is to provide a method of detecting life of an image bearing member in which an exchange time based on the life of the image bearing member and or that the exchange time is approaching can be accurately notified, an image forming apparatus, and further, a cartridge detachably attachable to the image forming apparatus.

Still another object of the present invention is, particularly, to provide a method of detecting life of an image bearing member in which that the image bearing member has reached the expiry of life or is approaching the expiry of life can be detected with accuracy in a case where the image bearing member is electrified under a plurality of electrification conditions and developing means can be alienated from the image bearing member, an image forming apparatus using the method, and further, a cartridge detachably attachable to the image forming apparatus.

BRIEF DESCRIPTION OF THE DRAWINGS

FIG. 5 is a flow chart showing one embodiment of detection of life of a photosensitive member in accordance with the present invention;

FIG. 6 is a flow chart of another embodiment of detection of life of a photosensitive member in accordance with the present invention;

FIG. 8 is a flow chart of still another embodiment of detection of life of a photosensitive member in accordance with the present invention.

DETAILED DESCRIPTION OF THE PREFERRED EMBODIMENTS

Hereinafter, a method of detecting life of an image bearing member, an image forming apparatus, and a cartridge according to the present invention are explained in detail with reference to the accompanying drawings.

(Embodiment 1)

Figure 1:
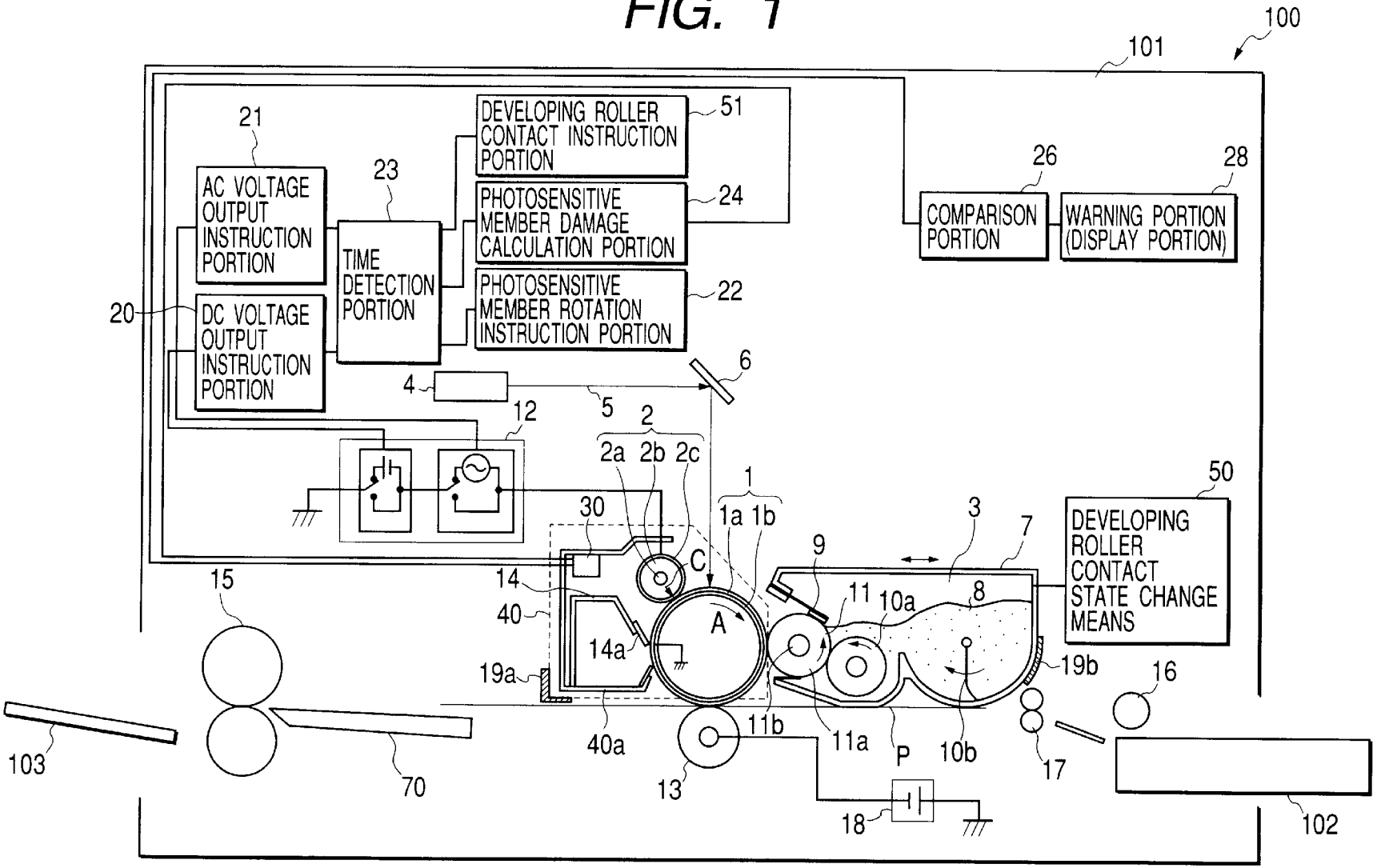
FIG. 1 is a schematic structural diagram showing one embodiment of an image forming apparatus according to the present invention.
Figure 2:
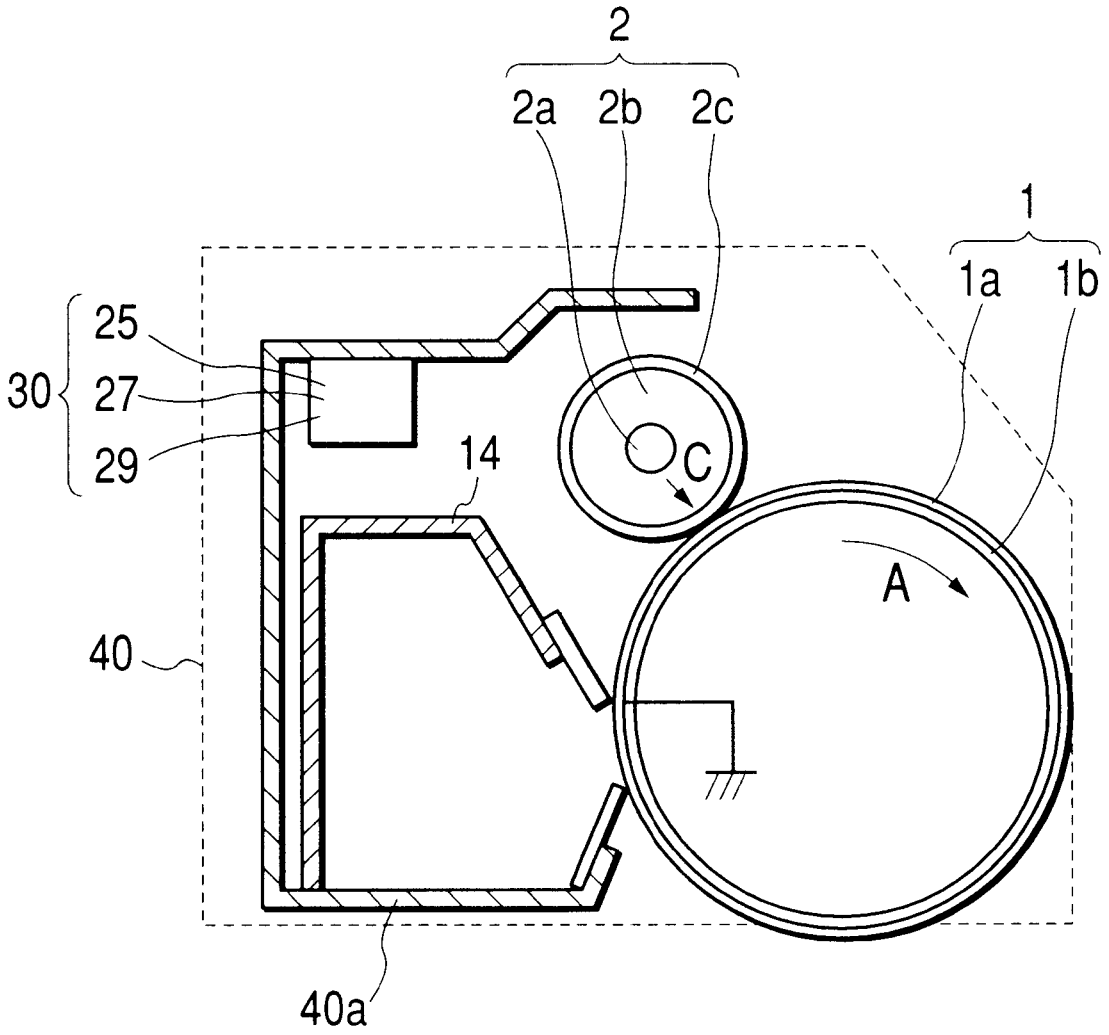
FIG. 2 is a schematic structural diagram showing one embodiment of a cartridge detachably attachable to the image forming apparatus of the present invention.

One embodiment of the image forming apparatus of the present invention is described with reference to FIGS. 1 and 2. FIG. 1 shows a schematic construction of the image forming apparatus of this embodiment. In this embodiment, the image forming apparatus is a printer of an electrophotographic system and particularly, a laser beam printer (LBP) 100 that performs exposure using laser light.

The printer 100 in this embodiment has a cylindrical electrophotographic photosensitive member (photosensitive member), that is, a photosensitive member drum 1 as an image bearing member as shown in FIG. 1. The photosensitive member drum 1 has an outer diameter of 30 mm, is structured by laminating a light conductive photosensitive layer 1*a* on a surface of a conductive base 1*b* made of aluminum, and is rotatingly driven with a peripheral speed of 100 mm/sec in an arrow A direction in the figure. In this embodiment, the photosensitive member drum 1 is an OPC photosensitive member drum having the photosensitive layer 1*a* with a polycarbonate resin as a main binder.

The photosensitive member drum 1 receives negative polar uniform electrification (primary electrification) by a charging roller 2 as a charging means. Subsequently, laser exposure 5 is output with resolution of 600 dpi from a laser scanner 4 provided as an optical system in accordance with a time-series electric digital image signal of image information sent from a video controller (not shown), and scanning exposure is performed on the photosensitive member drum 1 through a mirror 6. Thus, an electrostatic latent image is formed on the surface of the photosensitive member drum 1.

Reversal-developing is conducted on the electrostatic latent image on the photosensitive member drum 1 by a developer 8 carried on a developing roller 11 as a developer carrying member provided in a developing apparatus 7 as developing means, and the electrostatic latent image is visualized as a toner image.

On the other hand, a recording medium P is sent to the inside of an apparatus main body 101 from a recording medium cassette 102 as a recording medium receiving means by a feed roller 16 or the like, and is conveyed to a registration roller 17. The registration roller 17 sends the recording medium P to a transferring portion where the photosensitive member drum 1 and a transfer roller 13 as a transferring means are opposite to each other in synchronization with the formation of the toner image on the photosensitive member drum 1.

The toner image formed on the photosensitive member drum 1 is electrostatically transferred on the recording medium P by the transfer roller 13. Then, the recording medium P subjected to the transfer of the toner image is separated from the photosensitive member drum 1 to be introduced into a fixing apparatus 15 through a conveying means 70. After the toner image is fixed on the recording medium P, the recording medium P is discharged from the image forming apparatus main body 101, and is mounted on a discharge tray 103. The developer, which has not been transferred, what is called, waste toner, remaining on the photosensitive member drum 1 after the transfer process is cleaned at a cleaning device 14, and the photosensitive member drum 1 is subjected to the electrification process again. In this embodiment, the cleaning device 14 is provided with a blade cleaning member 14*a* as a cleaning means for scraping the waste toner by contacting the photosensitive member drum 1.

In this embodiment, the photosensitive member drum 1, the charging roller 2 and the cleaning device 14 are integrated by a casing (container) 40*a*, which is made as a drum unit (process cartridge) 40 detachably attachable to the apparatus main body 101. Further, the developing apparatus 7 is a developing unit detachably attachable to the apparatus main body 101 as another unit. The drum unit 40 and the developing unit are detachably and attachably supported by the apparatus main body 101 through mounting means 19*a*, 19*b*, respectively.

A storage element 30 as a storage means is mounted in the drum unit 40. Further, the container 40*a* of the drum unit 40 is provided with a connection terminal (not shown) in order to be able to communicate with a control portion of the apparatus main body 101 when the image forming apparatus is equipped with the drum unit 40, and reading-out and writing-in of information to the storage element 30 are possible.

As the storage means, an electronic memory (storage element) formed of general semiconductor such as a non-volatile memory or a combination of volatile memory and backup battery can be used without special limitation.

The developing apparatus (developing unit) 7 is further explained here. The developing apparatus 7 used in this embodiment adopts a contact developing system, and includes: the developing roller 11 as a developer carrying member which is rotatably supported and carries the developer 8 to the photosensitive member drum 1; a supply roller 10*a* for applying the developer 8 by rotating in a counter direction while contacting the developing roller 11; a developer containing chamber 3; and an agitating means 10*b* for agitating and carrying the developer and supplying the developer 8 in the direction of the supply roller 10*a*. The developing apparatus 7 is supported by the apparatus main body 101 such that the developing roller 11 is alienatably contactible with the photosensitive member drum 1, and the state of the developing roller 11 being in contact with or having a clearance with the photosensitive member drum 1 is changed by a contact state change means 50.

Figure 3A:
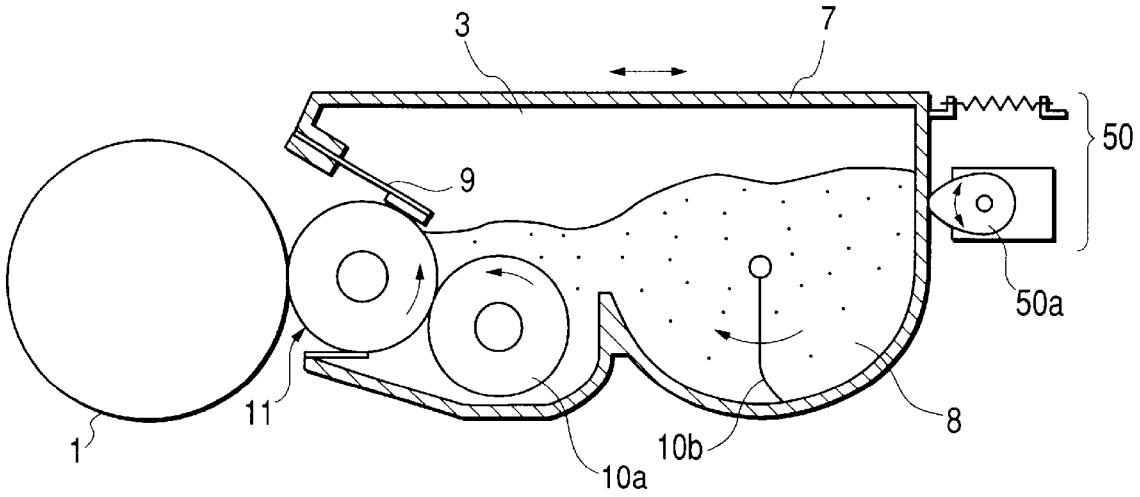
FIGS. 3A and 3B are schematic structural diagrams showing one embodiment of contact state change means of developing means.
Figure 3B:
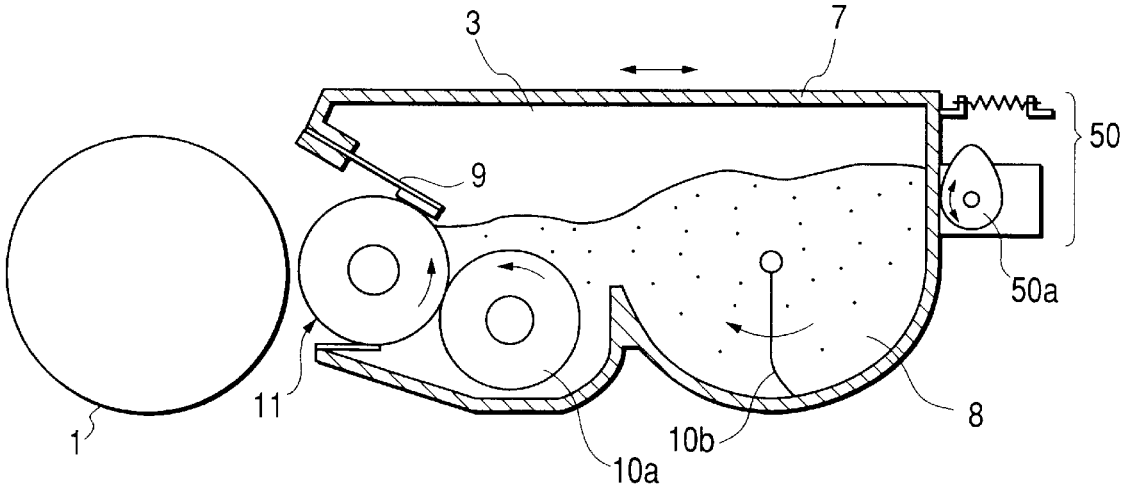

FIGS. 3A and 3B show an example of the contact state change means 50 of the developing roller 11. The contact state change means 50 of this embodiment has a cam member 50*a* contacting a part of the developing apparatus 7. The developing apparatus 7 slides in a horizontal direction by the rotation of the cam member 50*a* to change the state of the developing roller 11 being in contact with or having a clearance with the photosensitive member drum 1. FIG. 3A shows the state of the developing roller 11 being in contact with the photosensitive member drum 1 and FIG. 3B shows the state of the developing roller 11 having a clearance with the photosensitive member drum 1.

The developing roller 11 has a Structure in which a cored bar 11*b* is provided with a conductive elastic layer 11*a*, and is generally driven with a peripheral speed ratio of 100 to 200% (the speed at a peripheral speed ratio of 100% is the same as the speed of the photosensitive member drum 1) with respect to the photosensitive member drum 1 in accordance with a developing property of the developer. When the applied bias of −500 V is supplied, a thin layer of the developer 8 applied on the developing roller 11 by an elastic blade 9 as a developer layer thickness regulating member is transferred to the electrostatic latent image on the photosensitive member drum 1 in the opposing portion of the photosensitive member drum 1.

In this embodiment, non-magnetic one component toner (toner) is used as the developing toner 8, and the developer toner 8 is received in the developer containing chamber 3.

Further, the charging roller 2 as the contact charging means is further explained. The charging roller 2 has a two-layer structure in which a sponge layer 2*b* and a surface 2*c* are wound around a cored bar 2*a* (sponge charging roller). The cored bar 2*a* has a diameter of 6 mm, the outer diameter of the roller is 12 mm, and the roller length is about 220 mm. Further, both ends of the cored bar 2*a* in the longitudinal direction are pressurized with 500 gf (≈4.9N) in an arrow c direction in the figure, and the charging roller 2 contacts the photosensitive member drum 1 with a nip of approximately 1.5 mm. The charging roller 2 is driven and structured so as to followingly rotate with respect to the photosensitive member drum 1.

The charging roller 2 is connected with a charging bias applied source 12 through the cored bar 2*a*. In this embodiment, as shown in the sequence of the image forming operation of FIG. 4, in a part of the photosensitive member drum 1 during the rotation including an image forming region, a bias in which a DC bias of −700 V is superposed on an AC bias (peak to peak voltage of 1600 V, frequency of 1000 Hz, and sine wave) is applied as a charging bias applying condition 1, and the surface of the photosensitive member drum 1 is uniformly charged at about −680 V (AC charge). Further, as to other portions of the photosensitive member drum 1 during the rotation, there exist a portion in which only a DC bias of −1250 V is applied as a charging bias applying condition 2, and the surface of the photosensitive member drum 1 is charged at about −680 V (DC charge) and a portion not applied with a charging bias as a charging bias applying condition 3.

In this embodiment, the charging bias applying condition is changed in accordance with the following purposes.

Charging bias applying condition 1 (AC charge): In order to obtain a uniform and satisfactory image in an image region, and also, in order to remove the surface potential at the end of image formation, a DC bias superposed on an AC bias is used.

Charging bias applying condition 2 (DC charge): Although a uniform surface potential is not particularly required, a constant surface potential for prevention of an unnecessary spout of the developer from the developing apparatus 7, that is, an unnecessary developing operation and for cleaning of the transfer roller 13 is required. Thus, only a DC bias which gives a little amount of damage to the photosensitive member drum 1 is used.

Charging bias applying condition 3: Since a constant surface potential is not particularly required, a charging bias is not applied.

It is to be noted that, with the same purpose as for the charging bias applying condition 2, a method of lowering a voltage value (or a current value) of the AC bias, a method of lowering frequency, and the like can be used, and the methods are also effective.

Next, a method of detecting life of the photosensitive member drum 1 is explained as a method of detecting life of an image bearing member that is characteristic of the present invention.

As shown in FIG. 1, the rotating operation of the photosensitive member drum 1 is controlled by a photosensitive member rotation instruction portion 22. The charging roller 2 as the contact charging member is appropriately applied with an AC bias and a DC bias, which are independently controlled by an AC voltage output instruction portion 21 and a DC voltage output instruction portion 20, respectively, by the charging bias applied source 12.

Further, the contact state change means 50 is controlled by a developing roller contact instruction portion 51, and change the movement of the developing apparatus 7, that is, the state of the developing roller 11 being in contact with or having a clearance with the photosensitive member drum 1.

The AC voltage output instruction portion 21, the DC voltage output instruction portion 20 and the photosensitive member rotation instruction portion 22 are coupled with a time detection portion 23 as a time detection means, and applied times t1, t2 and t3 described later are detected under the respective charging bias applying conditions during one job of the image forming operation. Further, the developing roller contact instruction portion 51 is coupled with the time detection portion 23, and the time when the developing roller 11 contacts the photosensitive member drum 1 (developing roller contact time) td during one job of the image forming operation is detected.

Figure 4:
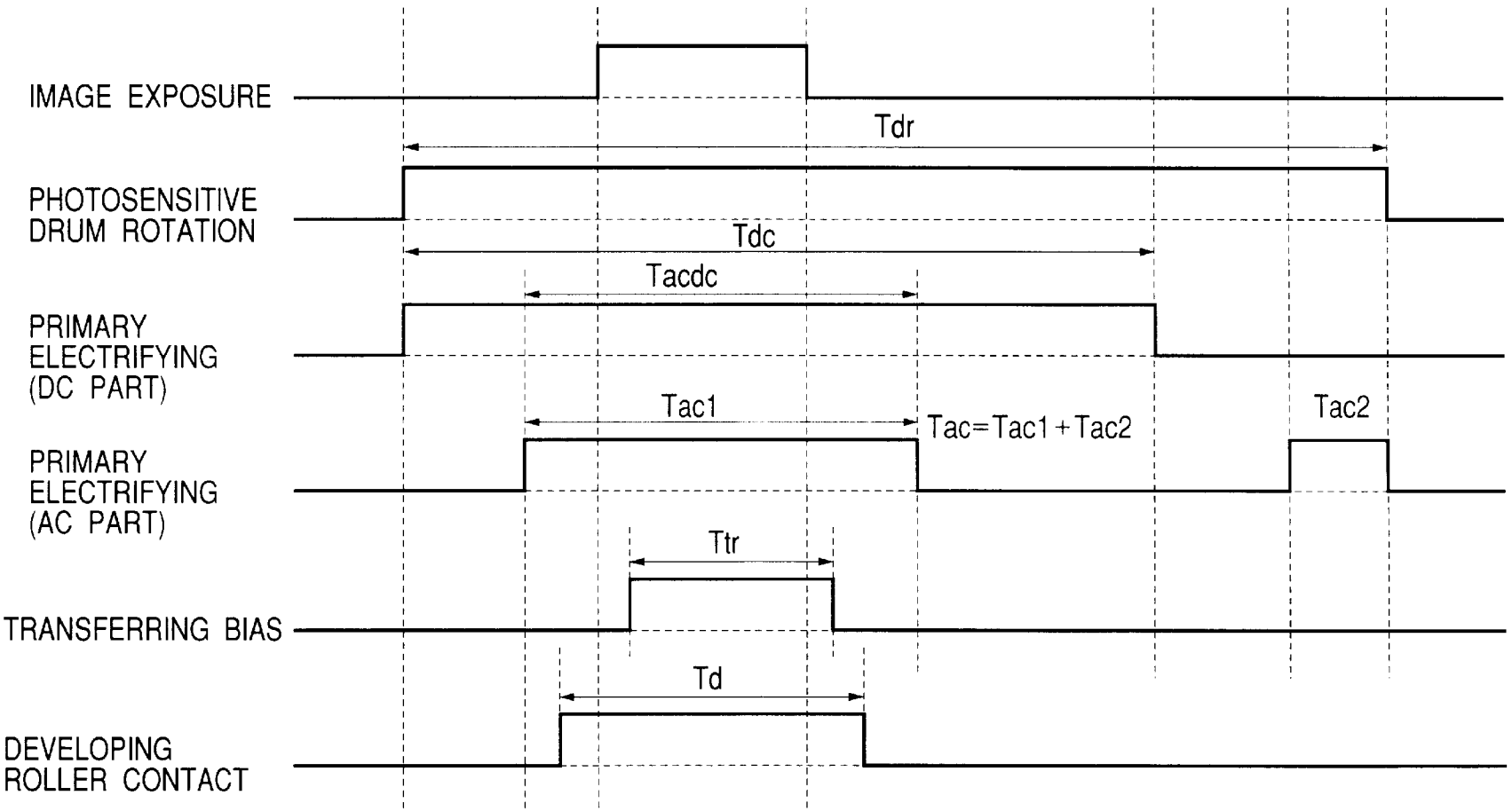
FIG. 4 is a timing chart showing one example of image forming operation of the image forming apparatus that can preferably implement the present invention.
Figure 7:
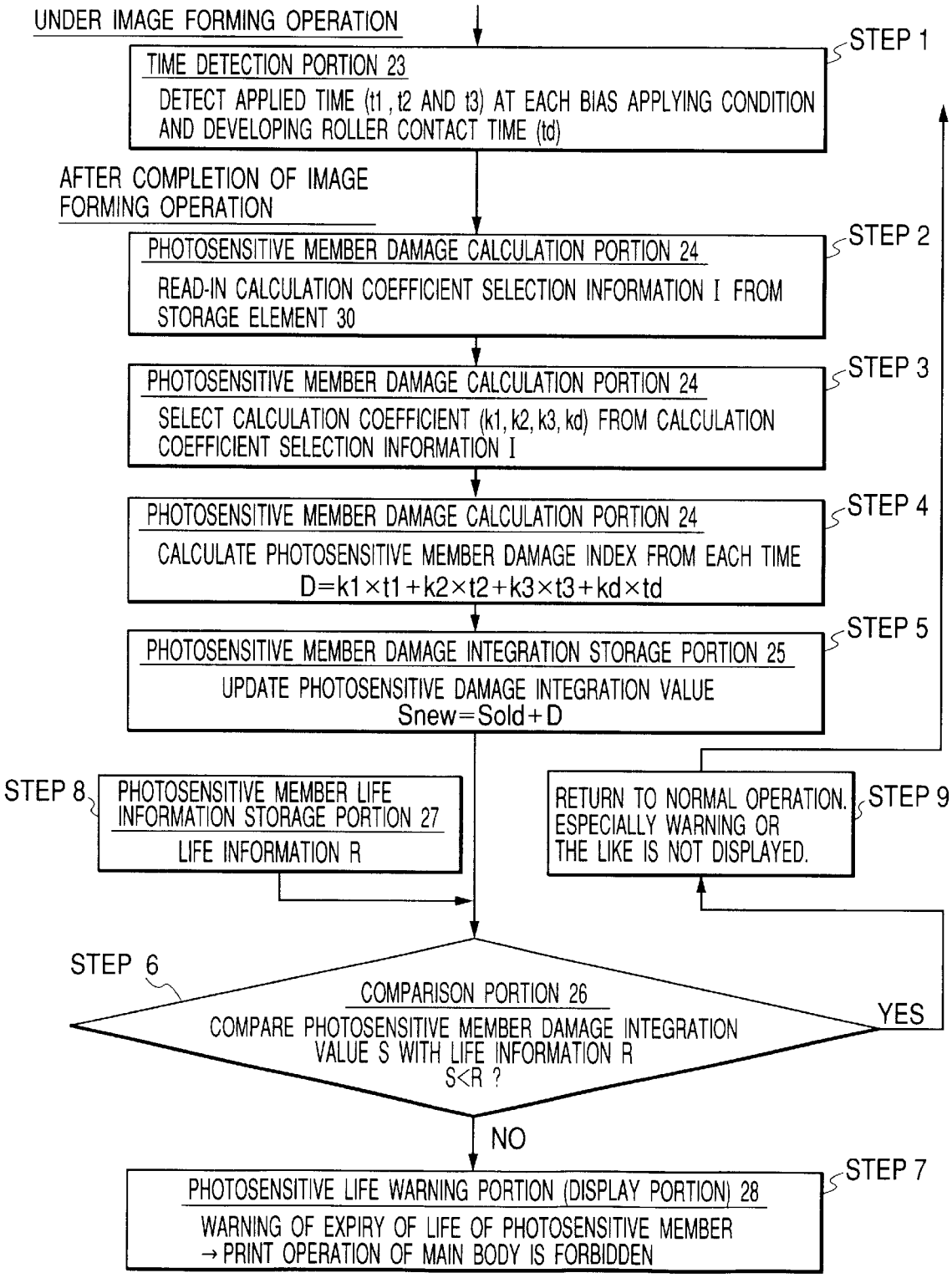
FIG. 7 is a flow chart of still another embodiment of detection of life of a photosensitive member in accordance with the present invention.

Here, as shown in the sequence of the image forming operation of FIG. 4, t1 corresponds to applied tine information Tac (t1=Tac=Tac1+Tac2) from the AC voltage output instruction portion 21, t2 corresponds to what is obtained by subtracting time Tacdc when the AC voltage is superposed from applied time information Tdc from the DC voltage output instruction portion 20 (t2=Tdc−Tacdc), and t3 corresponds to what is obtained by subtracting t1 and t2 from photosensitive member rotation time information Tdr from the photosensitive member rotation instruction portion 22 (t3=Tdr−(t1+t2)), that is, the time when the photosensitive member drum 1 rotates with the charging bias being off or of 0 V.

The procedure of detecting life of the photosensitive member drum 1 is explained with reference to a flow chart of one embodiment of the method of detecting life of the photosensitive member drum 1 shown in FIG. 5. First, during one job of the image forming operation, the applied times t1, t2 and t3 under the respective charging bias applying conditions and the time td when the developing roller 11 contacts the photosensitive member drum 1 are detected in the time detection portion 23 (step S1).

After the completion of one job of the image forming operation, the applied times t1, t2 and t3 under the respective charging bias applying conditions, the developing roller contact time td, and photosensitive member damage calculation coefficients k1, k2, k3 and kd contained in a photosensitive member damage calculation coefficient storage portion 29 in the storage means 30 of the drum unit 40 are delivered to a photosensitive member damage calculation portion 24 as an image bearing member damage calculation means (step S2). The photosensitive member damage calculation portion 24 is coupled with the storage means 30 in the drum unit 40 in such a state that the apparatus main body 101 is mounted with the drum unit 40.

Next, a photosensitive member damage index D which is a parameter relative to the photosensitive member damage is calculated by the following formula (1) (step S3):

$$D \times k1 \times t1 + k2 \times t2 + k3 \times t3 + kd \times td \quad (1)$$

(In this embodiment, the respective coefficient in the above formula are k1=1, k2=0.3, k3=0.1, and kd=0.3.)

The photosensitive member damage calculation portion 24 reads a photosensitive member damage integration value S stored in a photosensitive member damage integration storage portion 25 of the storage means 30 every one job of the image forming operation, and adds a photosensitive member damage index D during one job to the photosensitive member damage integration value S to update the photosensitive member damage integration value S as image bearing member damage integration means (Snew=Sold+D) (step S4). This is operation is repeated every one job of the image forming operation.

After the completion of one job of the image forming operation and then, the completion of the update of the integration value S stored in the storage means 30 of the drum unit 40, a comparison portion 26 as a comparison means reads life information R set in advance from a photosensitive member life information storage portion 27 of the storage means 30 of the drum unit 40 (step S7), and reads the updated integration value S from the photosensitive member damage integration storage portion 25 of the storage means 30 and compares the relationship in size with the updated photosensitive member damage integration value S (step S5).

Based on the result of the comparison in the step S5, in a case where the updated integration value S is equal to or more than the life information R (S≧R), for example, an information transmitting means served by the comparison portion 26 sends a signal to a photosensitive member life warning portion (display portion) 28 as a notifying means provided in the apparatus main body 101 in this embodiment, warns or displays that the photosensitive member drum 1 has reached the expiry of life, and forbids the image forming operation (step S6).

As to the determination at the step S5, in a case where the photosensitive member damage integration value S is smaller than the life information R (S<R), the warning and the display are not particularly made, and the operation returns to the normal operation (step S8).

The damage given to the photosensitive member drum 1 is further explained. As shown in the sequence of FIG. 4, the rotation time of the photosensitive member drum 1 (Tdr), the DC bias applied time (Tdc), the AC bias applied time (Tac), and the developing roller contact time (Td) are different from each other.

The present inventors examined the damage to the photosensitive member drum 1 in each state in the sequence of the image forming operation, in particular, abrasion of the photosensitive member drum 1 (drum abrasion). As a result, in a case where the drum abrasion in the state that bias is not applied is 1 in the state that the developing roller 11 contacts the photosensitive member drum 1, the drum abrasion in the state that a DC bias is applied is 2 to 3, the drum abrasion in the state that an AC bias is further applied is 8 to 10, and the drum abrasion in the state that a DC bias and an AC bias are applied while the developing roller 11 alienates the photosensitive member drum 1 is 6 to 8, which shows a large difference. This result was obtained by the examination with the system such that the OPC photosensitive member with a surface layer of which a main binder is a polycarbonate resin is used as the photosensitive member and the blade cleaning member is used as the cleaning means of the photosensitive member.

In accordance with the above result, when it is considered that, in general, the life of the photosensitive member drum 1 is determined dominantly by the drum abrasion, the applied times of the respective charging bias applying conditions are multiplied by predetermined coefficients, respectively, and the obtained results are summed up in case that there are a plurality of the charging bias applying conditions. Thus, the drum abrasion amount by the application of the charging bias is estimated, and the life of the photosensitive member drum 1 can be judged.

Further, as apparent from the above examination, the drum abrasion amount differs in the respective states of the developing roller 11 such as it being in contact with or having a clearance with the photosensitive member drum 1. The drum abrasion amount is larger in a case where the developing roller 11 contacts the photosensitive member drum 1. Therefore, in a case where the state of the developing roller 11 being in contact with or having a clearance with the photosensitive member drum 1 is changed, the time when the developing roller 11 contacts the photosensitive member drum 1 is multiplied by a predetermined coefficient to estimate the drum abrasion amount by the contact of the developing roller 11. Thus, the life of the photosensitive member drum 1 can be judged.

That is, a general formula $$D = \sum_{i=1}^{n} (ki \times ti) + (kd \times td)$$

(k1>0, ki (i≦2 to n)≧0, kd≧0) is used for the calculation of the photosensitive member damage index D, the index D is integrated to obtain the photosensitive member damage integration value S, and the drum abrasion amount is estimated. Thus, life detection with precision becomes possible.

In this embodiment, as described above, the applied times t1, t2 and t3 under the respective charging bias applying conditions during one job of the image forming operation and the developing roller contact time td are detected by the time detection portion 23, the photosensitive member damage index D is calculated using the formula (1) based on the above general formula and the respective coefficients set in advance with respect to the image forming apparatus of this embodiment (photosensitive member damage calculation coefficient) (k1, k2, k3, kd) by the photosensitive member damage calculation portion 24, and the photosensitive member damage integration value S is updated by the latest integration value. Thus, the abrasion amount of the photosensitive member drum 1 is estimated, and therefore, the life detection of the photosensitive member drum 1 with accuracy becomes possible.

In accordance with this embodiment, since the photosensitive member damage integration value S stored in each drum unit differs by providing the storage means 30 in the drum unit 40, discrimination of the drum unit is easily conducted. That is, at the exchange for the new drum unit, even if a user mounts the old drum unit by mistake, the respective drum units can be discriminated without particularly providing a discriminating means. Thus, an exchange error of the user can be prevented, and the defect such that the drum unit over the expiry of life is mistakenly used to output an defect image can be prevented.

Further, by previously storing the life information R of the photosensitive drum in the storage means 30 of the drum unit 40, the life of the drum unit can be appropriately detected and warning can be made in accordance with the set life of each drum unit even in a case where the drum unit with different set life is mounted.

Moreover, the photosensitive member damage calculation coefficients k1, k2, k3, and kd can be changed in accordance with the respective photosensitive member drums, or lots of the photosensitive member drums, and thus, the more appropriate life detection in accordance with the variation of the characteristic of the photosensitive member material, and the like becomes possible.

Note that, in this embodiment, the sponge charging roller 2 is used as the contact charging member, but a solid rubber roller may be used. Further, the contact charging member is not limited to a roller shape, and a blade shape, a brush shape, a brush roller and the like may be adopted.

Besides, in a case where the abrasion of the photosensitive member drum 1 is not largely influenced in the sequence of the image forming operation, that is, in a case where the calculation coefficient ki is remarkably small with respect to k1 or in a case where the applied time ti is remarkably small with respect to t1, the item of the bias applying condition may be omitted to the extent that the required precision is not dropped.

Furthermore, in this embodiment, it is explained that the photosensitive member damage calculation coefficients k1, k2, k3, and kd stored in the storage means 30 every one job of the image formation are input in the photosensitive member damage calculation portion 24. However, the input may be performed one time when the power source of the apparatus main body 101 is turned ON.

In accordance with this embodiment, the life of the photosensitive member drum 1, that is, the expiry of life of the electrophotograph can be accurately detected, and the exchange time based on the life of the photosensitive member drum 1 can be notified with accuracy. Therefore, since the satisfactory photosensitive member drum 1 may always be used, the satisfactory image may always be obtained.

(Embodiment 2)

Another embodiment of the present invention is explained below. An image forming apparatus of this embodiment has basically the same structure as the image forming apparatus of Embodiment 1 shown in FIG. 1. Therefore, the elements with the same functions and structures have the same reference numerals, and detailed description thereof is omitted.

A method of detecting life of the photosensitive member drum 1 in this embodiment is explained with reference to a flow chart of FIG. 6. Steps 1 to 4 in FIG. 6 are the same as those in Embodiment 1 of FIG. 5, and therefore the description thereof is omitted.

In this embodiment, information for determining the life of the photosensitive member drum 1 is set in 2 levels. That is, in this embodiment, the photosensitive member life information storage portion 27 provided in the storage means 30 in the drum unit 40 is set in two levels of warning information Y for instructing a user to prepare exchange, and real photosensitive member life information R at the time when the photosensitive member drum 1 has drawn to the expiry of life. Of course, the warning information Y<the photosensitive member life information R.

After the completion of one job of the image forming operation by the steps 1 to 4, and further, after the completion of the updating of the integration value S stored in the photosensitive member damage integration storage portion 25 of the storage means 30, the comparison portion 26 reads in the warning information Y and the life information R set in advance from the photosensitive member life information storage portion 27 of the storage means 30 (step S7), reads in the updated integration value S from the photosensitive member damage integration storage portion 25 of the storage means 30, and first compares the photosensitive damage integration value S and the warning information Y (step S5). As a result, when the updated photosensitive member damage integration value S is smaller than the warning information Y (S<Y), the operation returns to the normal image forming sequence, and the life warning information of the photosensitive member drum 1 is not displayed (step S8).

Next, as a result of comparing the photosensitive member damage integration value S and the warning information Y in the step S5, if the photosensitive member damage integration value S is equal to or more than the warning information Y (S≧Y), the photosensitive member damage integration value S and the life information R are subsequently compared (step S6). As a result of the comparison in the step S6, if the photosensitive member damage integration value S is smaller than the life information R (S<r), this indicates that the expiry of life of the photosensitive member drum 1 is approaching. Thus, the usual image forming operation is continued, while, for example, an information transmitting means served by the comparison portion 26 sends a signal to a photosensitive member life warning portion (display portion) which is a notifying means provided in the apparatus main body 101, and the photosensitive member life warning portion (display portion) 28 instructs urging of the user to prepare the exchange (step S9). On the other hand, as a result of the comparison in the step S6, if the photosensitive member damage integration value S is equal to or more than the life information R (S≧R), the photosensitive member life warning portion (display portion) 28 notifies the user of the expiry of life of the photosensitive member drum 1, and instructs urging of the user to exchange the photosensitive member drum 1, and also the print operation is prevented (step S10). Then, when it is confirmed that the photosensitive member drum 1 is exchanged, the print operation is again granted.

In this embodiment, the information to determine the life of the photosensitive member drum 1 is set in two levels of the warning information Y and the life information R. It is needless to say that the user may be informed of more detailed life information of the photosensitive member by setting the levels with more levels.

In accordance with this embodiment described above, the life of the photosensitive member drum 1, namely, that the electrophotograph has reached the expiry of life or is approaching the expiry of life, may be accurately detected, and the exchange time based on the life of the photosensitive member drum 1 or that the exchange time is approaching may be accurately notified. Therefore, the satisfactory photosensitive member drum 1 may always be used so that a satisfactory image may always be obtained.

(Embodiment 3)

Hereinafter, another embodiment of the present invention is explained. An image forming apparatus of this embodiment has basically the same structure as the image forming apparatus of Embodiment 1 shown in FIG. 1. Therefore, elements with the same functions and structures have the same reference numerals, and the detailed description is omitted.

In this embodiment, the photosensitive member damage calculation coefficient storage portion 29 inside the storage means 30 does not have the photosensitive member damage calculation coefficients k1, k2, k3 and kd, but photosensitive member damage calculation coefficient selection information I. This photosensitive member damage calculation coefficient selection information I is, for example, formed of ten pieces of information I as shown in the photosensitive member damage calculation coefficient table of the table 1, and the pieces of photosensitive member damage calculation coefficient selection information I are related to the combination with the differing photosensitive member damage Calculation coefficients k1, k2, k3 and kd. This photosensitive member damage calculation portion 24 selects one set from the combinations of the photosensitive member calculation coefficients k1, k2, k3 and kd and performs calculations based on the photosensitive member life coefficient selection information I in the storage means 30, in accordance with the photosensitive member coefficient table of the table 1 that is set in advance and held.

TABLE 1

| Calculation Coefficient selection information I | Coefficient k1 | k2 | k3 | kd |
|---|---|---|---|---|
| 0 | 1 | 0.3 | 0.1 | 0.3 |
| 1 | 1 | 0.4 | 0.1 | 0.3 |
| 2 | 1 | 0.5 | 0.1 | 0.3 |
| 3 | 1 | 0.6 | 0.1 | 0.3 |
| 4 | 1 | 0.3 | 0 | 0.3 |
| 5 | 1 | 0.4 | 0 | 0.3 |
| 6 | 1 | 0.5 | 0 | 0.3 |
| 7 | 1 | 0.6 | 0 | 0.3 |
| 8 | 0.8 | 0.3 | 0.1 | 0.3 |
| 9 | 0.5 | 0.3 | 0.1 | 0.2 |

First, the applied times t1, t2 and t3 of the respective bias applying conditions in one job of the image forming operation, and the time td when the developing roller 11 is in contact with the photosensitive member drum 1 are detected in the time detection portion 23 (step S1).

After one job of the image forming operation is completed, the applied times t1, t2 and t3 under the respective charging bias applying conditions, the developing roller contact time td, and the photosensitive member damage calculation coefficient selection information I stored in the photosensitive member damage calculation coefficient storage portion 29 of the storage means 30 of the drum unit 40 are handed over to the photosensitive member damage calculation portion S4 (step S2). The photosensitive member damage calculation portion 24 is coupled with the storage means 30 of the drum unit 40 in the state that the drum unit 40 is mounted to the apparatus main body 101. Here, the photosensitive member damage calculation portion 24 selects one set of the calculation coefficients k1, k2, k3 and kd based on the photosensitive member damage calculation coefficient selection information I (step S3).

Next, the photosensitive member damage index D is calculated from the formula (1);

$$D=k1\times t1+k2\times t2+k3\times t3+kd\times td \quad (1)$$

(In this embodiment, the coefficients in the above formula are k1=1, k2=0.3, k3=0.1, kd=0.3 (where the photosensitive member damage calculation coefficient selection information I=0).) (step S4).

Further, the photosensitive member damage calculation portion 24 adds the photosensitive member damage index D in one job to the photosensitive member damage integration value S stored in the storage means 30, and updates the photosensitive member damage integration value S (Snew=Sold+D) (step S5). This operation is repeated for every one job of the image forming operation.

When one job of the image forming operation is completed, and the updating of the integration value S stored in the photosensitive member damage integration storage portion 25 of the storage means 30 of the drum unit 40 is completed, the comparison portion 26 reads in the life information R set and stored in advance from the photosensitive member life information storage portion 27 of the storage means 30 of the drum unit 40 (step S8), reads in the updated integration value S from the photosensitive member damage integration storage portion of the storage means 30, and compares the size relationship between the life information R and the integration value S (step S6).

When the result of the comparison in the step S6 shows that the updated integration value S is equal to or more than the life information R (S≧R), a signal is sent to the photosensitive member life warning portion (display portion) 28 provided in the apparatus main body 101, that the photosensitive member drum 1 has reached its expiry of life is warned or displayed, and the image forming operation of the main body is forbidden (step S7).

When the result of the comparison in the step S6 shows that the photosensitive member damage integration value S is smaller than the life information R (S<R), warning or displaying is not particularly performed, and the operation returns to the normal operation (step S9).

In this embodiment, the photosensitive member calculation coefficients k1, k2, k3 and kd are not stored in the storage means 30 of the drum unit 40, and by storing the photosensitive member coefficient selection information I, the information held in the storage means 30 may be reduced. Thus, the capacity of the storage means may be reduced, and the cost of the storage means may be made lower.

Note that, in this embodiment, the photosensitive member calculation coefficient selection information I inside the storage means 30 was passed to the photosensitive member damage calculation portion 24 for every one job in the image formation, but the information may be passed just once when the power source of the apparatus main body 101 is turned ON.

According to the present invention, the life of the photosensitive member drum 1, namely, that the electrophotograph has reached the expiry of life may be accurately detected, and the exchange time based on the life of the photosensitive member drum 1 may be accurately notified. Therefore, since the satisfactory photosensitive member drum 1 may always be used, a satisfactory image may always be obtained. Further, with the structure of this embodiment, the memory capacity provided in a cartridge may be made smaller.

(Embodiment 4)

Hereinafter, still another embodiment of the present invention is explained. An image forming apparatus of this embodiment has basically the same structure as the image forming apparatus of Embodiment 1 shown in FIG. 1. Therefore, elements with the same functions have the same reference numerals, and the detailed description is omitted.

In this embodiment, as in Embodiment 2, information to determine the life of the photosensitive member is set in two levels. In this embodiment, the levels are warning information Y for instructing to urge the user for exchange at the time when the expiry of life of the photosensitive member drum 1 is approaching, and life information R which means the real photosensitive member life. Of course, the size relationship is expressed as the warning information Y<the life information R.

Further, in this embodiment, the photosensitive member life information storage portion 27 of the storage means 30 inside the drum unit 40 is stored with photosensitive member life selection information J instead of the warning information Y and the life information R. This photosensitive member life selection information J is, for example, formed of ten pieces of life selection information J as shown in the photosensitive member life information table of the table 2, and the pieces of photosensitive member life selection information J are related to different combinations of the warning information Y and the life information R. In this embodiment, the comparison portion 26 holds the photosensitive member life information table showing the relationship between the photosensitive member life selection information J shown in the table 2, and the warning information Y and the life information R. Further, the comparison portion 26 selects one set from the combinations of the warning information Y and the life information R, in accordance with the photosensitive member life selection information J read in from the storage means 30 of the drum unit 40.

TABLE 2

| | Life, Warning | |
|---|---|---|
| Life selection information J | Warning information Y | Life information R |
| 0 | 100000 | 150000 |
| 1 | 200000 | 300000 |
| 2 | 100000 | 120000 |
| 3 | 100000 | 200000 |
| 4 | 100000 | 160000 |
| 5 | 100000 | 170000 |
| 6 | 100000 | 180000 |
| 7 | 140000 | 150000 |
| 8 | 145000 | 150000 |
| 9 | 190000 | 200000 |

First, the applied times t1, t2, t3 under the respective bias applying conditions in one job of the image forming operation, and the time td in which the developing roller 11 is in contact with the photosensitive member drum 1 are detected by the time detection portion 23 (step S1).

After one job of the image forming operation is completed, the applied times t1, t2 and t3 under the respective charging bias applying conditions, the developing roller contact time td, and the photosensitive member damage calculation coefficients k1, k2, k3, stored in the photosensitive member damage calculation coefficient storage portion 29 in the storage means 30 of the drum unit 40 are handed over to the photosensitive member damage calculation portion 24 (step S2). Here, the photosensitive member damage calculation portion 24 is coupled with the storage means 30 in the drum unit 40 in a state that the drum unit 40 is mounted to the apparatus main body 101.

Next, the photosensitive member damage index D is calculated by the formula (1), $$D=k1\times t1+k2\times t2+k3\times t3+kd\times td \quad (1)$$

(In this embodiment, the coefficients in the above formula are k1=1, k2=0.3, k3=0.1, kd=0.3) (step S3).

Further, the photosensitive member damage calculation portion 24 adds the photosensitive member damage index D in one job to the photosensitive member damage integration value S stored in the storage means 30, and updates the photosensitive member damage integration value S (Snew=

Sold+D) (step S4). This operation is repeated for every one job of the image forming operation.

When one job of the image forming operation is completed, and the updating of the integration value S stored in the photosensitive member damage integration storage portion 25 of the storage means 30 of the drum unit 40 is completed, the comparison portion 26 reads out the photosensitive member life selection information J from the photosensitive member life information storage portion 27 of the storage means 30 (step S5), and selects the warning information Y and the life information R from the photosensitive member life information table shown in the table 2 in accordance with the photosensitive member life selection information J (step S6). On the other hand, the updated photosensitive member damage integration value S is read in from the photosensitive member damage integration storage portion 25, and first the updated photosensitive member damage integration value S and the warning information Y are compared (step S7).

As a result of the comparison in the step S7, if the updated photosensitive member damage integration value S is smaller than the warning information Y (S<Y), the operation returns to the normal image forming sequence, and the life warning information of the photosensitive member drum 1 is not displayed (step S8). On the other hand, as a result of the comparison in the step S7, if the photosensitive member damage integration value S is equal to or more than the warning information Y (S≧Y), the photosensitive member damage integration value S and the life information R are compared next (step S9).

As a result of the comparison in the step S9, if the photosensitive member damage integration value S is smaller than the life information (S<R), it indicates that the expiry of life of the photosensitive member drum 1 is approaching and the photosensitive member life warning portion (display portion) 28 instructs the user to urge the preparation of exchange (step S10). On the other hand, as a result of the comparison in the step S9, if the photosensitive member damage integration value S is equal to or more than the life information (S≧R), the user is notified that the expiry of life of the photosensitive member has been reached in the warning portion (display portion) 28, and instructed to urge the exchange of the photosensitive member drum 1, and the image forming operation is stopped (step S11). Then, when it is confirmed that the photosensitive member drum 1 is newly exchanged, the print operation is again allowed.

In this embodiment, by storing not the warning information Y and the life information R but the photosensitive member life selection information J in the storage means 30, the information held in the storage means 30 may be reduced, the capacity of the storage means 30 may be reduced, and the cost of the storage means may be made lower.

Note that, in this embodiment, the photosensitive member life selection information J in the storage means 30 is passed to the comparison portion 26 for every one job of the image forming operation, but the information may be passed only once when the power source of the apparatus main body 101 is turned ON.

In accordance with this embodiment, the life of the photosensitive member drum 1, namely, that the electrophotograph has reached the expiry of life or is approaching the expiry of life may be accurately detected, and the exchange time based on the life of the photosensitive member drum 1, or that the exchange time is approaching may be accurately notified. Accordingly, the satisfactory photosensitive member drum 1 may always be used, and a satisfactory image may always be obtained. Also, with the structure of this embodiment, the capacity of a cartridge may be made smaller.

(Embodiment 5)

Figure 9:
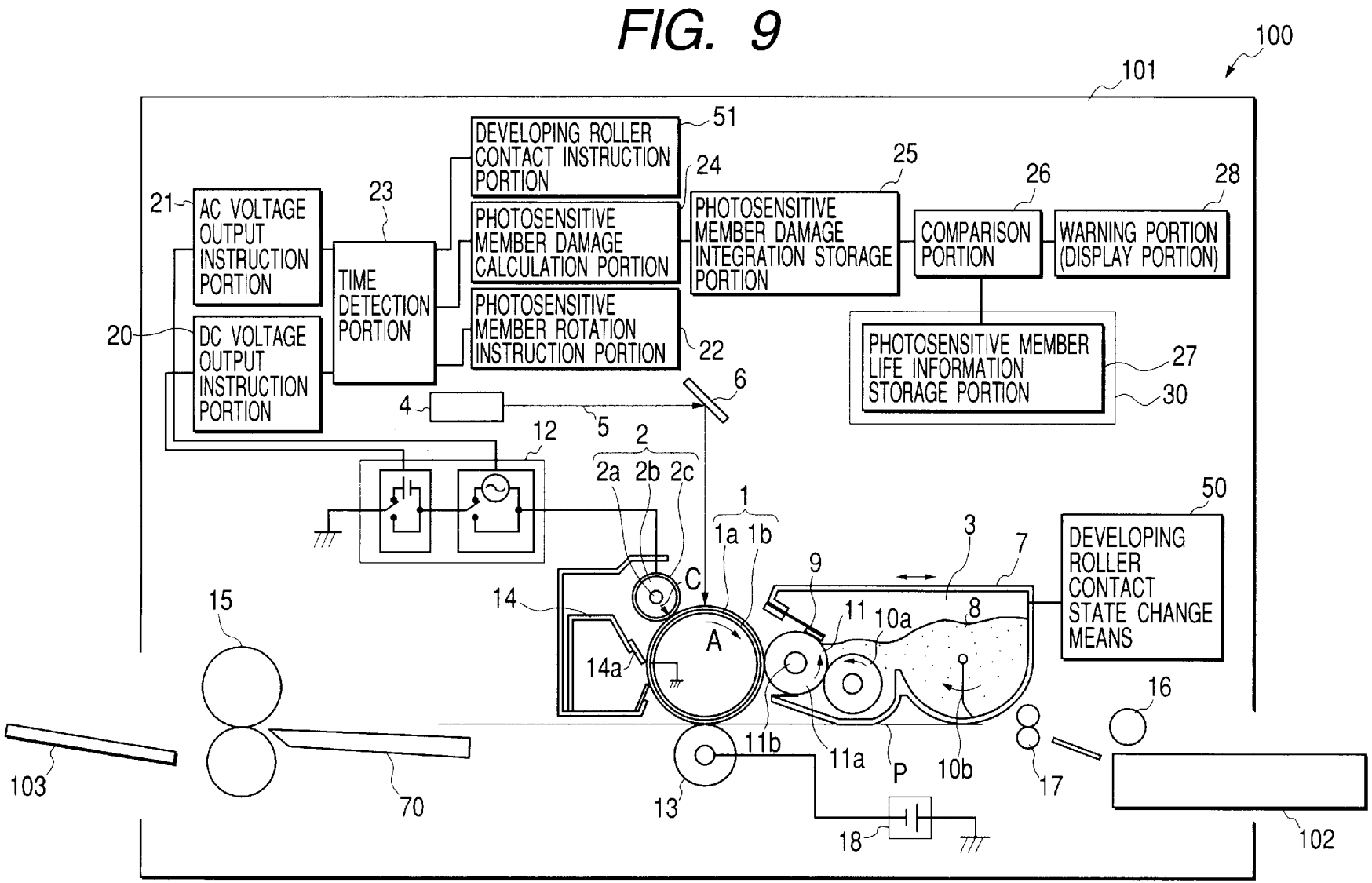
FIG. 9 is a schematic structural diagram of another embodiment of an image forming apparatus of the present invention.

In the image forming apparatuses of Embodiments 1 to 4 described above, as a cartridge detachably attachable to the apparatus main body 101, the drum unit including at least the photosensitive member drum (process cartridge) 40 is made detachably attachable with the apparatus main body 101, and the structure is made such that the storage means 30 is mounted on the drum unit 40. However, in this embodiment, as shown in FIG. 9, instead of an integral type process cartridge structure, in a structure in which process means of the electrophotographic image formation (electrophotographic photosensitive member, charging means, developing means, and cleaning means) are each mounted to the image forming apparatus main body 101, the photosensitive member damage integration storage portion 25, the photosensitive member life information storage portion 27, and the like are respectively mounted on the apparatus main body 101. Note that, the photosensitive member damage integration storage portion 25 and the photosensitive member life information storage portion 27 may of course be integrated with the storage means 30. Further, the photosensitive member damage calculation coefficient information (ki, kd) is held in the photosensitive member damage calculation portion 24 in this embodiment.

Note that, even if the photosensitive member is damage calculation coefficients (ki, kd) are held as the photosensitive member damage calculation coefficient information, an arbitrary means for identifying the photosensitive member drum 1 to be mounted on the apparatus main body 101 is provided, namely, the means corresponding to the photosensitive member damage calculation coefficient selection information I explained in Embodiment 3 is held in the photosensitive member drum 1, (for example, input from the input portion of the apparatus main body at the time of mounting of the photosensitive member drum 1, and mechanical identification of the type of each photosensitive member drum 1 can be performed). Thus, the structure may be such that one of the combinations of the plurality of photosensitive member damage calculation coefficients (ki, kd) is selected for use.

In this embodiment, by applying the process explained in Embodiments 1 to 4, substantially the same operation effect as Embodiments 1 to 4 may be obtained. Note that, for the explanations, the explanation of Embodiments 1 to 4 will be referenced.

Note that, in each of Embodiments described above, it is explained that the warning portion (display portion) 28 as a notifying means provided in the apparatus main body 101 as the notifying means to notify that the photosensitive member drum 1 has reached its expiry of life, or is approaching the expiry of life. However, the present invention is not limited thereto, and for example, a screen (display) of equipment such as a host computer which is connected to have communication with the image forming apparatus main body 101 may be used as a notifying means. Further, as a notifying means, notification by a warning message or a voice, and recording to the recording medium and output are of course also possible. Any notifying method may be adopted as long as the user is notified of the expiry of life of the image bearing member or that the expiry of the life is near, and can tell the appropriate exchange time of the image bearing member, that the time is near, etc.

As described above, the above method of detecting life of an image bearing member is structured to judge the life of the image bearing member by: (a) calculating the image bearing member damage index D showing the exhaustion degree of the image bearing member by using the applied times for the respective conditions of the charging bias applied to the charging means for forming an electrostatic image on the image bearing member and/or the contact time of the developing means for developing the electrostatic image on the image bearing member; (b) integrating the image bearing member damage index D and storing it as the image bearing member damage integration value S; and (c) comparing the image bearing member damage integration value S and the life information R that corresponds to the image bearing member damage integration value S in the life of the image bearing member which is previously set. Further, the image forming apparatus of the present invention which adopts the above method comprises: the image bearing member; the charging means for charging the image bearing member under the n types (n≧1) of charging bias conditions i (i=1 to n); the developing means performing developing by contacting the image bearing member; the time detection means for detecting the time ti when the charging bias is applied to the charging means under the charging bias condition i (i=1 to n) and the contact time td to the image bearing member of the developing means; the calculation means for calculating the damage index D of the image bearing member based on the formula, $$D = \sum_{i=1}^{n} (ki \times ti) + (kd \times td)$$

(where, k1>0, ki (i=2 to n)≧0, kd≧0), using the detected times ti (i=1 to n) and td, and the coefficients ki (i=1 to n) and kd; the integration means for obtaining the image bearing member damage integration value S by integrating the image bearing member damage index D; and the comparison means for comparing the image bearing member damage integration value S and the life information R that corresponds to the image bearing member damage integration value S in the life of the image bearing member which is previously set. Further, since the cartridge detachably attachable to the image forming apparatus is also provided, that the image bearing member has reached the expiry of life or is approaching the expiry of life may be accurately detected, and the exchange time based on the life of the image bearing member or that the exchange time is near may be accurately notified. According to the present invention, that the image bearing member has reached the expiry of life or is approaching the expiry of life may be accurately detected particularly in a case where the image bearing member is charged with the plurality of charging conditions and the developing means may be in contact with or have a clearance image bearing member.

What is claimed is:

1. A method of detecting the end of the life of an image bearing member comprising:

a contact time detecting step of detecting the contact time when a developer carrying member that can have a contact or a clearance with an image bearing member contacts said image bearing member, said developer carrying member developing an electrostatic image formed on said image bearing member by a developer; and a determining step of determining the end of the life of said image bearing member in accordance with a parameter calculated by using the contact time detected in said contact time detecting step.

2. A method according to claim 1, wherein said detecting method further comprises a storing step of storing an integration value obtained by integrating the parameter, and wherein said determining step determines the end of the life of said image bearing member in accordance with the integration value.

3. A method according to claim 2, wherein, in said determining step, the end of the life of said image bearing member is determined by comparing the integration value and life information of said image bearing member in which the integration value is previously determined.

4. A method according to claim 1, wherein said detecting method comprises a voltage applied time detecting step of detecting the applied time of a voltage applied to charging means for charging said image bearing member, which is used for forming the electrostatic image on said image bearing member, and the parameter is calculated by using the voltage applied time.

5. A method according to claim 4, wherein the voltage applied time comprises n (n≧1) kinds of voltage applied times for n kinds of respective voltage applied conditions applied to said charging means.

6. A method according to claim 5, wherein the parameter is calculated based on $$D = \sum_{i=1}^{n} (ki \times ti) + (kd \times td)$$

using the voltage applied time ti (i=1 to n) for each of the n kinds of voltage applied conditions i (i=1 to n) , the contact time td, a coefficient ki (i=1 to n) and kd (k1>0, ki (i=2 to n)≧0, kd≧0).

7. A method according to claim 3, wherein a notification is issued that said image bearing member has reached the end of its life when the integration value is equal to or more than the life information.

8. A method according to claim 1, wherein, in said determining step, it is warned that the end of the life of said image bearing member is near in accordance with the parameter before the determination of the life of said image bearing member.

9. A method according to claim 7, wherein a warning is issued that the end of the life of said image bearing member is near when the integration value is equal to or more than warning information and is smaller than the life information in comparison with the warning information in which the integration value is previously determined.

10. An image forming apparatus comprising:

an image bearing member;

a developer carrying member for developing an electrostatic image formed on said image bearing member by a developer, said developer carrying member being capable of being in contact with and having a clearance with said image bearing member;

detection means for detecting the contact time when said developer carrying member contacts said image bearing member; and determining means for determining the life of said image bearing member in accordance with a parameter calculated by using the contact time detected by said detection means.

11. An apparatus according to claim 10, wherein said apparatus comprises storage means for storing an integration value obtained by integrating the parameter, and said determining means determines the life of said image bearing member in accordance with the integration value.

12. An apparatus according to claim 11, wherein said apparatus comprises comparison means for comparing the integration value and predetermined life information of said image bearing member.

13. An apparatus according to claim 10, wherein said apparatus comprises charging means for charging said image bearing member, which is used for forming the electrostatic image on said image bearing member, said detection means detects the applied time of a voltage applied to said charging means, and the parameter is calculated by using the voltage applied time.

14. An apparatus according to claim 13, wherein the voltage applied time comprises n (n≧1) kinds of voltage applied times for n kinds of respective voltage applied conditions applied to said charging means.

15. An apparatus according to claim 13 or 14, wherein said charging means is provided being in contact with said image bearing member.

16. An apparatus according to claim 15, wherein the parameter is calculated based on $$D = \sum_{i=1}^{n} (ki \times ti) + (kd \times td)$$

using the voltage applied time ti (i=1 to n) for each of the n kinds of voltage applied conditions i (i=1 to n), the contact time td, a coefficient ki (i=1 to n) and kd ( k1>0, ki (i=2 to n)≧0, kd≧0).

17. An apparatus according to claim 12, wherein a notification is issued that said image bearing member has reached the end of its life when the integration value is equal to or more than the life information.

18. An apparatus according to claim 10, wherein, said determining means warns that the end of the life of said image bearing member is near in accordance with the parameter before the determination of the life of said image bearing member.

19. An apparatus according to claim 17, wherein a warning is issued that the end of the life of said image bearing member is near when the integration value is equal to or more than warning information and is smaller than the life information in comparison with the warning information in which the integration value is previously determined.

20. An apparatus according to claim 10, wherein said apparatus comprises a cartridge detachably attachable to a main body of said apparatus, and said image bearing member is provided in said cartridge.

21. An apparatus according to claim 11, wherein said apparatus comprises a cartridge detachably attachable to a main body of said apparatus, and said image bearing member and said storage means are provided in said cartridge.

22. An apparatus according to claim 16, wherein said apparatus has a cartridge detachably attachable to a main body of said apparatus, and said cartridge comprises said image bearing member and storage means for storing the coefficients ki and kd.

23. An apparatus according to claim 16, wherein said apparatus has a cartridge detachably attachable to a main body of said apparatus, said cartridge comprises said image bearing member and storage means for storing coefficient selection information, and wherein one set is selected from among a plurality of sets of coefficients ki and kd which are previously set in accordance with the coefficient selection information.

24. An apparatus according to claim 12, wherein said apparatus has a cartridge detachably attachable to a main body of said apparatus, and said cartridge comprises said image bearing member and storage means for storing the life information.

25. An apparatus according to claim 19, wherein said apparatus has a cartridge detachably attachable to a main body of said apparatus, and said cartridge comprises said image bearing member and storage means for storing the warning information.

26. An apparatus according to claim 12, wherein said apparatus has a cartridge detachably attachable to a main body of said apparatus, said cartridge comprises said image bearing member and storage means for storing image bearing member life selection information, and one of a plurality of pieces of life information previously set in accordance with the image bearing member life selection information being selected.

27. An apparatus according to claim 19, wherein said apparatus has a cartridge detachably attachable to a main body of said apparatus, wherein said cartridge comprises said image bearing member and storage means for storing image bearing member life selection information, and one of a plurality of pieces of warning information previously set in accordance with the image bearing member life selection information being selected.

28. A cartridge detachably attachable to a main body of an image forming apparatus, comprising:

an image bearing member; and storage means; wherein, the main body of said image forming apparatus is a developer carrying member that develops an electrostatic image formed on said image bearing member by a developer, and comprises: detection means for detecting the contact time when said developer carrying member, which is capable of being in contact with and having a clearance with said image bearing member, contacts said image bearing member; and comparison means for comparing a parameter calculated by using the product of the contact time detected by said detection means by a coefficient kd, and life information of said image bearing member, and wherein, said storage means stores at least one of the coefficient kd and the life information.

29. A cartridge according to claim 28, wherein:

said detection means is charging means for charging said image bearing member, and detects n (n≧1) kinds of voltage applied times for n kinds of respective voltage applied conditions applied to said charging means used for forming the electrostatic image on said image bearing member;

wherein the parameter is calculated based on $$D = \sum_{i=1}^{n} (ki \times ti) + (kd \times td)$$

using the voltage applied time ti (i=1 to n) for each of the n kinds of voltage applied conditions i (i=1 to n), the contact time td, a coefficient ki (i=1 to n) and the kd (k1>0, ki (i=2 to n)≧0, kd≧0);

wherein the parameter D and the life information are compared by said comparison means; and wherein said storage means stores the coefficient ki and the coefficient kd.

30. A cartridge according to claim 28, wherein said storage means stores warning information warning that the end of life of said image bearing member is near, and said comparison means compares the parameter and the warning information.

31. A cartridge according to claim 28, wherein said image bearing member is a photosensitive member, and said cartridge comprises at least one of said developer carrying member, charging means for charging said image bearing member, and cleaning means for cleaning said image bearing member.

32. A cartridge detachably attachable to a main body of an image forming apparatus, comprising:

an image bearing member; and storage means; wherein, the main body of said image forming apparatus is a developer carrying member that develops an electrostatic image formed on said image bearing member by a developer, and comprises: detection means for detecting the contact time when said developer carrying member, which is capable of being in contact with and having a clearance with said image bearing member, contacts said image bearing member; and comparison means for comparing a parameter calculated by using the product of the contact time detected by said detection means by a coefficient kd, and life information of said image bearing member, and wherein, said storage means stores coefficient selection information, and as to the coefficient kd, one of a plurality of coefficients set in advance is selected in accordance with the coefficient selection information.

33. A cartridge according to claim 32, wherein:

said detection means is charging means for charging said image bearing member, detects n ($n \geqq 1$) kinds of voltage applied times for n kinds of respective voltage applied conditions applied to said charging means used for forming the electrostatic image on said image bearing member;

wherein the parameter is calculated based on $$D = \sum_{i=1}^{n} (ki \times ti) + (kd \times td)$$

using the voltage applied time ti (i=1 to n) for each of the n kinds of voltage applied conditions i (i=1 to n), the contact time td, a coefficient ki (i=1 to n) and the coefficient kd ($k1>0$, ki (i=2 to n)$\geqq 0$, $kd \geqq 0$);

wherein the parameter D and the life information are compared by said comparison means; and as to the coefficient ki, one of a plurality of coefficients set in advance is selected in accordance with the coefficient selection information stored in said storage means.

34. A cartridge according to claim 32, wherein said storage means stores warning information warning that the end of life of said image bearing member is near, and said comparison means compares the parameter and the warning information.

35. A cartridge according to claim 32, wherein said image bearing member is a photosensitive member, and said cartridge comprises at least one of said developer carrying member, charging means for charging said image bearing member, and cleaning means for cleaning said image bearing member.

36. A cartridge detachably attachable to a main body of an image forming apparatus, comprising:

an image bearing member; and storage means; wherein, the main body of said image forming apparatus is a developer carrying member that develops an electrostatic image formed on said image bearing member by a developer, and comprises: detection means for detecting the contact time when said developer carrying member, which is capable of being in contact with and having a clearance with said image bearing member, contacts said image bearing member; and comparison means for comparing a parameter calculated by using the product of the contact time detected by said detection means by a coefficient kd, and life information of said image bearing member, and wherein, said storage means stores image bearing member life selection information, and as to the life information, one of a plurality of pieces of life information set in advance is selected in accordance with said image bearing member life selection information.

37. A cartridge according to claim 36, wherein said comparison means compares the parameter and warning information warning that the end of life of said image bearing member is near, and as to the warning information, one of a plurality of pieces of warning information set in advance is selected in accordance with said image bearing member life selection information.

38. A cartridge according to claim 36, wherein said image bearing member is a photosensitive member, and said cartridge comprises at least one of said developer carrying member, charging means for charging said image bearing member, and cleaning means for cleaning said image bearing member.

39. A cartridge detachably attachable to a main body of an image forming apparatus, comprising:

an image bearing member; and storage means;

wherein when said cartridge is attached to the main body of said image forming apparatus, a developer carrying member is capable of developing an electrostatic image formed on said image bearing member by a developer, the main body of said image forming apparatus detects a contact time when said developer carrying member, which is capable of being in contact with and having a clearance with said image bearing member, contacts said image bearing member, and determines a life of said image bearing member in accordance with a parameter calculated by using the contact time, and, said storage means stores the parameter.

40. A cartridge according to claim 39, wherein said image bearing member is a photosensitive member, and said cartridge comprises at least one of said developer carrying member, charging means for charging said image bearing member, and cleaning means for cleaning said image bearing member.

41. A cartridge according to claim 39, wherein the main body of said image forming apparatus includes means for detecting the contact time and means for determining the life of said image bearing member.

42. A method of detecting the life of an image bearing member comprising:

a contact time detecting step of detecting the contact time when a developer carrying member that can have a contact or a clearance with said image bearing member contacts said image bearing member, said developer carrying member developing an electrostatic image formed in said image bearing member by a developer; and a determining step of determining the life of said image bearing member in accordance with the contact time detected in said contact time detecting step.

43. An image forming apparatus comprising:

an image bearing member;

a developer carrying member for developing an electrostatic image formed on said image bearing member by a developer, said developer carrying member being capable of being in contact with and having a clearance with said image bearing member;

detection means for detecting the contact time when said developer carrying member contacts said image bearing member; and determining means for determining the life of said image bearing member in accordance with the contact time detected by said detection means.

44. An apparatus according to claim 43, wherein said apparatus further comprises storage means for storing information corresponding to the contact time, and said determining means determines the life of said image bearing member in accordance with the information.

45. A cartridge detachably attachable to a main body of an image forming apparatus, comprising:

an image bearing member; and storage means, wherein when said cartridge is attached to the main body of said image forming apparatus, a developer carrying member is capable of developing an electrostatic image formed on said image bearing member by a developer, the main body of said image forming apparatus detecting a contact time when said developer carrying member, which is capable of being in contact with and having a clearance with said image bearing member, contacts said image bearing member, and determining a life of said image bearing member in accordance with the contact time, and said storage means store information corresponding to the contact time.

46. A cartridge according to claim 45, wherein said image bearing member is a photosensitive member, and said cartridge comprises at least one of said developer carrying member, charging means for charging said image bearing member, and cleaning means for cleaning said image bearing member.

47. A cartridge according to claim 45, wherein the main body of said image forming apparatus includes means for detecting the contact time and means for determining the life of said imaging bearing member.

48. A cartridge according to claim 45, wherein the information corresponds to an applying time during which a voltage is applied to charging means for charging said image bearing member.

* * * * *

UNITED STATES PATENT AND TRADEMARK OFFICE

CERTIFICATE OF CORRECTION

PATENT NO. : 6,577,823 B2 
DATED : June 10, 2003
INVENTOR(S) : Minoru Matsuguma et al.

It is certified that error appears in the above-identified patent and that said Letters Patent is hereby corrected as shown below:

Column 1,
Line 9, “abanonded” should read -- abandoned --.
Line 31, “electrophotograh” should read -- electrophotographic --.

Column 5,
Line 29, “merits-” should read -- merits --.

Column 10,
Line 8, “Structure” should read -- structure --.

Column 11,
Line 39, “tine” should read -- time --.

Column 12,
Line 10, “DxK1xt1+k2xt2+k3xt3+kdxtd” should read -- D=k1xt1+k2xt2+k3xt3+ kdxtd --.
Line 11, “coefficient” should read -- coefficients --.
Line 12, “kd=0.03.)” should read -- kd=0.03). --.

Column 13,
Line 38, “(k1 > 0, ki (i ≤ 2 to n) ≥ 0, kd ≥ 0)” should read -- (k1>0, ki (i=2 to n) ≥ 0, kd ≥ 0) --.

Column 14,
Line 2, “an defect” should read -- a defective --.

Column 15,
Line 23, “R (S<r),” should read -- R (S<R), --.

Column 16,
Line 11, “Calculation” should read -- calculation --.
Line 48, “portion S4” should read -- portion 24 --.
Line 63, “I=0).)” should read -- I = 0)), --.

Column 18,
Line 49, “k3,” should read -- k3, kd --.

UNITED STATES PATENT AND TRADEMARK OFFICE

CERTIFICATE OF CORRECTION

PATENT NO. : 6,577,823 B2
DATED : June 10, 2003
INVENTOR(S) : Minoru Matsuguma et al.

It is certified that error appears in the above-identified patent and that said Letters Patent is hereby corrected as shown below:

Column 20,
Line 28, “is” should be deleted.
Line 49, “of” should read -- of the --.

Column 21,
Line 52, “clearance” should read -- clearance with the --.

Column 22,
Line 30, “(i=1 to n) ,” should read -- (i = 1 to n), --.

Column 23,
Line 23, “Is” should read -- is --.
Line 28, “( k1>0,” should read -- (k1>0, --.
Line 48, “a” should read -- an --.

Column 24,
Line 59, “the” should be deleted.

Column 28,
Line 10, “store” should read -- stores --.

Signed and Sealed this

Third Day of February, 2004

JON W. DUDAS
*Acting Director of the United States Patent and Trademark Office*